US005169141A

United States Patent [19]

Ahl et al.

[11] Patent Number: 5,169,141

[45] Date of Patent: Dec. 8, 1992

[54] FLOATING TRANSFER MODULE MOUNTING

[75] Inventors: David K. Ahl; Timothy G. Struczewski, both of Rochester; Scott A. Reese, Farmington; James R. Cassano, Penfield; Roger M. Swanson, Fairport; Scott C. Durland, Rochester; Roman C. Kanola, Naples; Richard M. Dastin, Fairport; Daniel R. Shavers, Rochester; John H. Dearlove, Webster; Arthur J. Sobon; Miguel O. Martinez, both of Rochester; Ashok T. Patel, Webster, all of N.Y.

[73] Assignee: Xerox Corporation, Stamford, Conn.

[21] Appl. No.: 755,986

[22] Filed: Sep. 6, 1991

[51] Int. Cl.[5] ..... B65H 5/06

[52] U.S. Cl. ..... 271/274; 271/263

[58] Field of Search ..... 271/272, 273, 274, 262, 271/263, 245

[56] References Cited

U.S. PATENT DOCUMENTS

| | | | |
|---|---|---|---|
| 3,883,242 | 5/1975 | Takahashi et al. | 355/3 |
| 4,431,180 | 2/1984 | Nakajima | 271/274 |
| 4,432,632 | 2/1984 | Yokota | 355/3 |
| 4,739,371 | 4/1988 | Ray et al. | 355/16 |
| 4,769,671 | 9/1988 | Koff | 271/273 X |
| 4,804,993 | 2/1989 | Kenin et al. | 355/3 |
| 4,912,509 | 3/1990 | Kaneshige | 355/210 |

*Primary Examiner*—Richard A. Schacher

*Attorney, Agent, or Firm*—Kenyon & Kenyon

[57] ABSTRACT

A registration transport and transfer module is located in a retractable drawer having a camshaft actuated by a lever. Rotation of the lever turns the cam which cooperates with a mounting to enable the transfer module to be lowered beneath a photoconductive belt. The drawer may then be pulled away from the machine and the transfer module pivoted about a point so as to expose portions of the copy sheet path for jam clearance.

15 Claims, 24 Drawing Sheets

FLOATING TRANSFER MODULE MOUNTING

BACKGROUND OF THE INVENTION

The invention relates generally to a color electronic reprographic printing system, and more particularly concerns an apparatus for clearing paper jams within the portion of the printing system that transports paper stock from a supply bin to a location point at which an image is transferred to the paper or other copy stock.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member is developed by bringing toner into contract therewith. The image is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal to the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

From time to time, the copy sheet may become jammed at some point along its path inside the machine. In order to enable the user to resolve this problem on his own, reprographic machines are typically designed with portions of the paper path accessible to the user for clearance of the paper jam. In the case of a color reprographic system, a portion of the paper path lies along a generally oval loop, known as a two roll transfer loop, or TRTL, upon which the copy sheet must be recirculated for color copying. In use, the TRTL must be positioned so that it can bring paper very close to an overlying photoconductive surface for image transfer. Copy sheets are routed to the TRTL by a so-called registration module. These portions of the paper path are susceptible to jamming. There is a need to provide for the clearance of the jam in this area of the machine in a manner that is both simple enough for the user to affect and that minimizes the risk of damage to the machine, particularly the sensitive photoconductive surface.

SUMMARY OF THE INVENTION

The problems are overcome by the method and apparatus of the invention.

An extendible drawer known as a TRD, or TRTL-Registration drawer, is provided that contains pivotally separable registration and transfer loop structure. The drawer is unlocked from the remainder of the machine by a handle whose rotation serves to lower the registration and transfer loop structure with respect to a photosensitive belt. There is further provided structure for preventing the pivoting of the TRTL until it has cleared the photoconductive belt. When the drawer is in its fully extended position, the transfer loop may be pivoted about a common point. As this pivoting occurs, baffles which are in the registration module, and which are connected by a linkage to the TRTL to help define the paper path in this region are separated so as to allow the user sufficient access to clear this portion of the machine of any paper jam. Once the jam has been cleared, the TRTL is rotated, closing the baffles, and the drawer is pushed back into the machine and the handle rotated to its original position, which raises and restores the transfer loop and registration structure to their original operating positions.

The objects of the invention include:

- Clearance between the transfer module (TRTL) and the photoreceptor, when opening the drawer, to prevent photoreceptor damage
- Accurate positioning and alignment between the registration gate assembly and the TRTL, to provide reliable paper loading to the gripper bar
- Accurate vertical spacing of the TRTL with respect to the photoreceptor module to minimize lead edge deletion and other Copy quality defects
- The ability to adjust alignment of the TRTL with respect to the photoreceptor, which is critical to color registration
- The ability to pivot the TRTL sufficiently to clear jams which occur on the underside of the assembly
- A method of opening the registration baffles to allow jam clearance from this area The mounting of all assemblies within the TRD centers around two pivot pins, located on the inboard and outboard side plates of the TRTL. These pins rest in two "Cradle Arms," which pivot about pins mounted to the TRD. These cradle arms are loosely connected to a lifting bar which runs underneath the TRTL, along its full length. This loose mounting allows the TRTL to float vertically, both at its inboard and outboard sides, so that when lifted toward the photoreceptor module, the TRTL's vertical alignment is free to match the position of the photoreceptor.

This lifting motion is accomplished via a cam, mounted to a camshaft which runs the full length of the drawer, and which mounts in bearings in the front and rear plates of the TRD. The cam is centrally located in the depth direction to provide the desired lifting forces at both inboard and outboard TRTL pins, while allowing independent inboard and outboard vertical motion. The lifting force is supplied by deformation of the lifting bar and the camshaft, whose spring constants are calculated to provide the desired force to hold the TRTL against the photoreceptor staging points.

In the down (drawer out) position, the TRTL is positioned below the photoreceptor, so that the action of pulling out the drawer does not damage the photoreceptor. After the drawer is closed, a handle attached to the cam shaft is rotated, and the TRTL raises to contact the photoreceptor on three accurately positioned staging points, one inboard and two outboard. This sets the plane of the gripper bar motion within the TRTL accurately with respect to the plane of the photoreceptor in the image transfer area.

The stage points on the photoreceptor module consist of three flat sections on the photoreceptor module side plates, accurately located with respect to the photoreceptor. The three TRTL stage points are rollers, mounted on adjustable brackets, which are accurately set with respect to the gripper bar. These rollers allow free horizontal motion of the TRTL stage points with respect to the photoreceptor stage points during the staging process, which was found to be important to the accurate and repeatable positioning of the TRTL.

Alignment between the TRTL and the photoreceptor module (important for proper color registration) is achieved via a skew adjustment mechanism which mounts the outboard cradle arm. This mechanism mounts the pivot point of the cradle arm in a second vertically mounted pivoting arm. An adjustment screw is provided to allow the horizontal adjustment of the outboard TRTL pin, which alters the TRTL to photoreceptor alignment. A spring is provided to remove backlash in the mechanism, and a clamping screw prevents rotation of the adjusting screw during machine operation.

Alignment of the registration gate assembly with respect to the TRTL is important for reliable paper loading. This alignment, both vertical and horizontal, is achieved by mounting two alignment arms, which are part of the registration gate frame, to the same pins on the TRTL frame which mount in the cradle arms. The registration gate arms mount outside of the TRTL and the cradle arms, and latch all assemblies together by means of a one piece latch at each end of the registration gate frame. Once latched together, the alignment of the registration gate assembly will automatically match that of the TRTL. A third mounting point is located under the registration gate assembly. The registration gate assembly and the TRTL are latched together by two sheet metal latches which mount with one screw to the alignment arm of the registration gate assembly and have sections which cover the tops of the TRTL pins. The screw hole in each latch is slotted, so that they may be positioned to the left to allow removal of the TRTL by loosening, but not removing, the retaining screw.

With all assemblies latched together, and the drawer pulled out, the TRTL may be rotated counterclockwise to allow jam clearance from the underside of the TRTL. This motion also pulls on a link which rotates two levers on the registration gate assembly, parting the registration gate baffles. This linkage allows access to two jam clearance areas with one motion.

The weight of the TRTL is supported during rotation by a counterbalance system, which mounts on the main camshaft. This system also balances the TRTL during staging, which was found to be important for repeatable positioning. A stop screw disengages this lever from the TRTL slightly before the TRTL reaches the photoreceptor, so the counterbalance exerts no force on the TRTL in the up (run) position.

Rotating the TRTL with the drawer not completely out could damage the photoreceptor. Therefore, a feature was added to the photoreceptor side plate, to prevent such premature motion. This feature is positioned below the photoreceptor, and located such that the upper right tie bar, which runs the length of the TRTL, will strike this feature if the TRTL is rotated while the drawer is partially in, before anything else touches the photoreceptor.

Similarly, raising the TRTL before the TRD is completely inserted could damage the photoreceptor. This motion is therefore prevented by means of an additional mechanism. A spring loaded stop interferes with the motion of the latch mounted to the camshaft, preventing the camshaft from turning. When the TRD is pushed in, the latch bracket on the rear casting pushes the stop inboard, allowing the shaft to turn.

The advantages of the invention include:

Ease of jam clearance (all areas accessible with few motions)

Accurate TRTL to photoreceptor module alignment

Accurate TRTL to photoreceptor module vertical positioning

Accurate TRTL to registration gate alignment

Ease of assembly removal

Minimizes possibility of photoreceptor damage when clearing jams.

DETAILED DESCRIPTION

Figure 1:
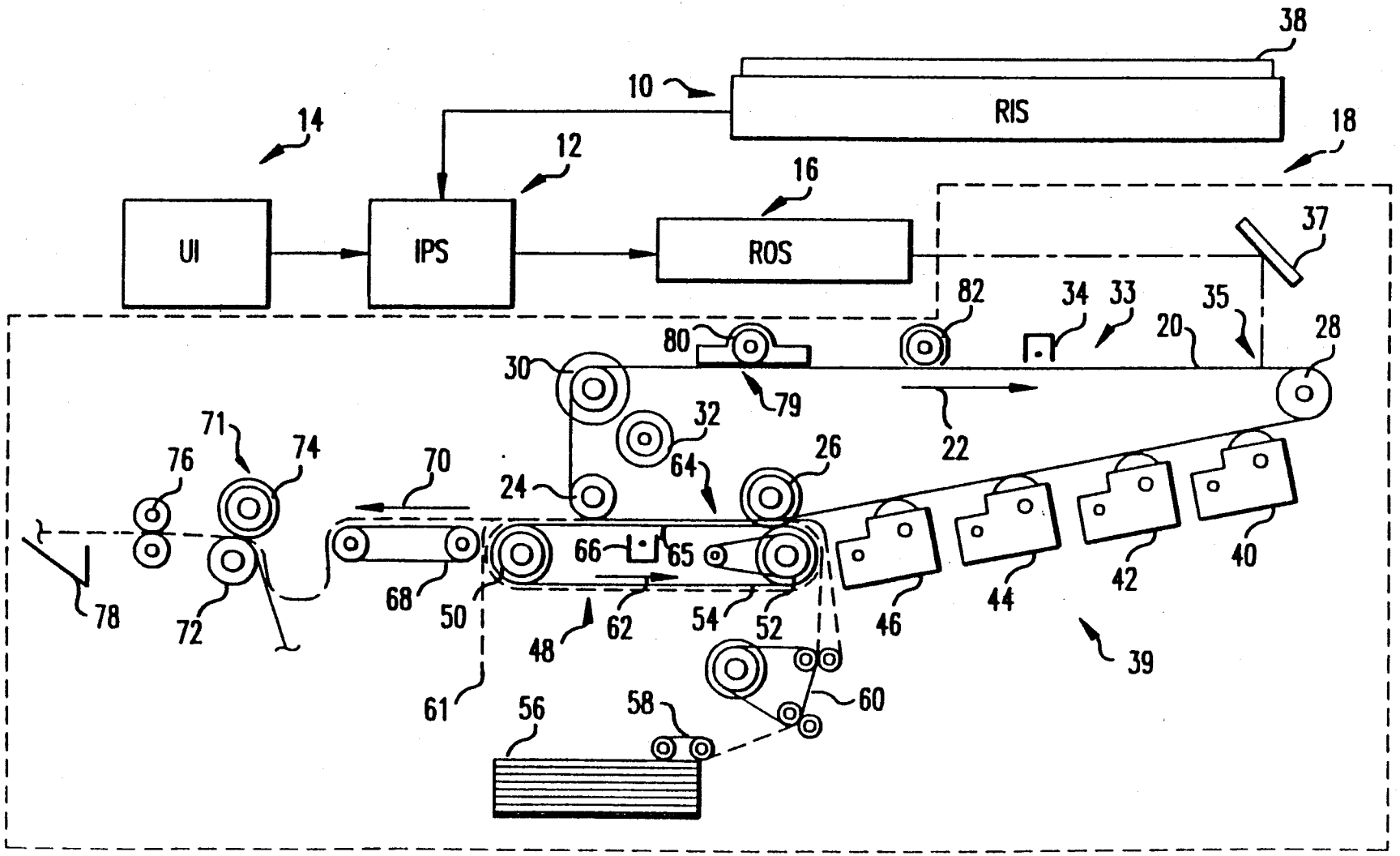
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD) array. The RIS captures the entire original document and converts it to a series of raster scan lines and measures a set of primary color densities, i.e. red, green, and blue densities, at each point of the original document. This information is transmitted to an image processing system (IPS), indicated generally by the reference numeral 12. IPS 12 contains control electronics that prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser and an associated rotating polygon mirror block. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines, which are transmitted as electrical signals to IPS 12. The electrical signals from RIS 10 correspond to the red, green, and blue densities at each point in the original document. IPS 12 converts the set of red, green, and blue density signals, i.e., the set of signals corresponding to the primary color densities of original document 38, to a set of calorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) tone particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44, and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

Figure 2:
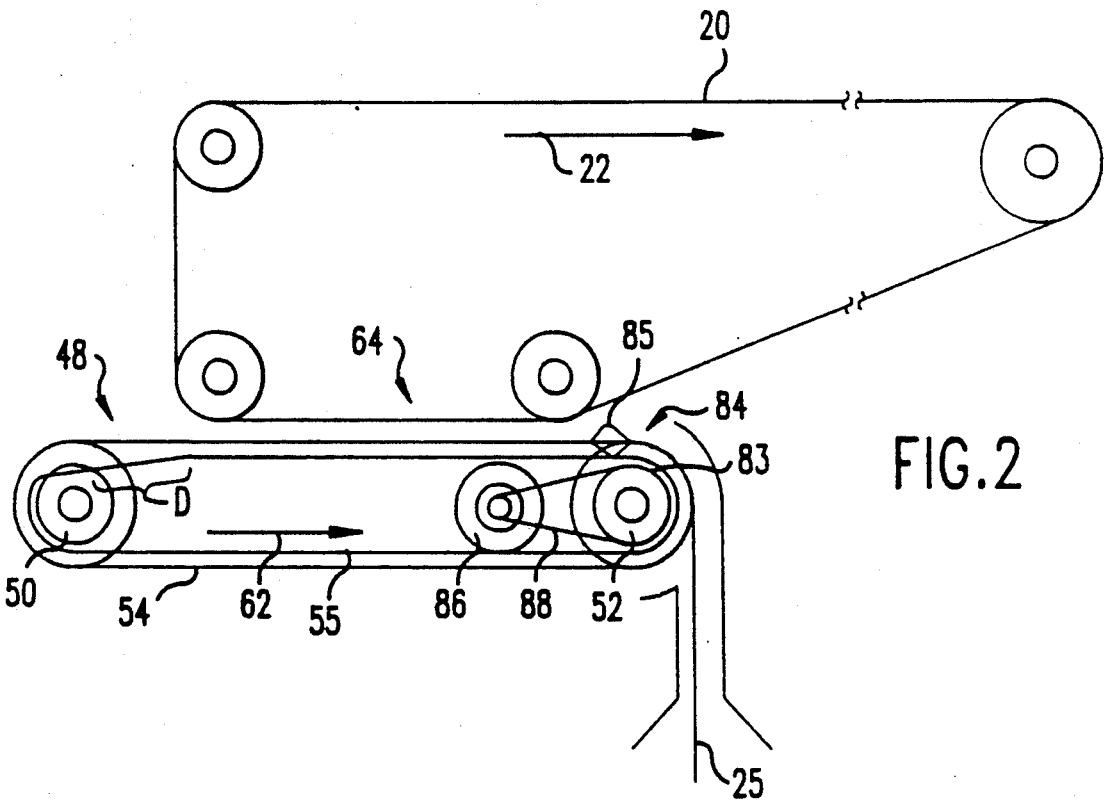
FIG. 2 is a schematic elevational view showing further details of the sheet transport system used in the electrophotographic printing machine of FIG. 1 and also showing the sheet gripper of the sheet transport system at a position prior to entering the transfer zone.
Figure 3:
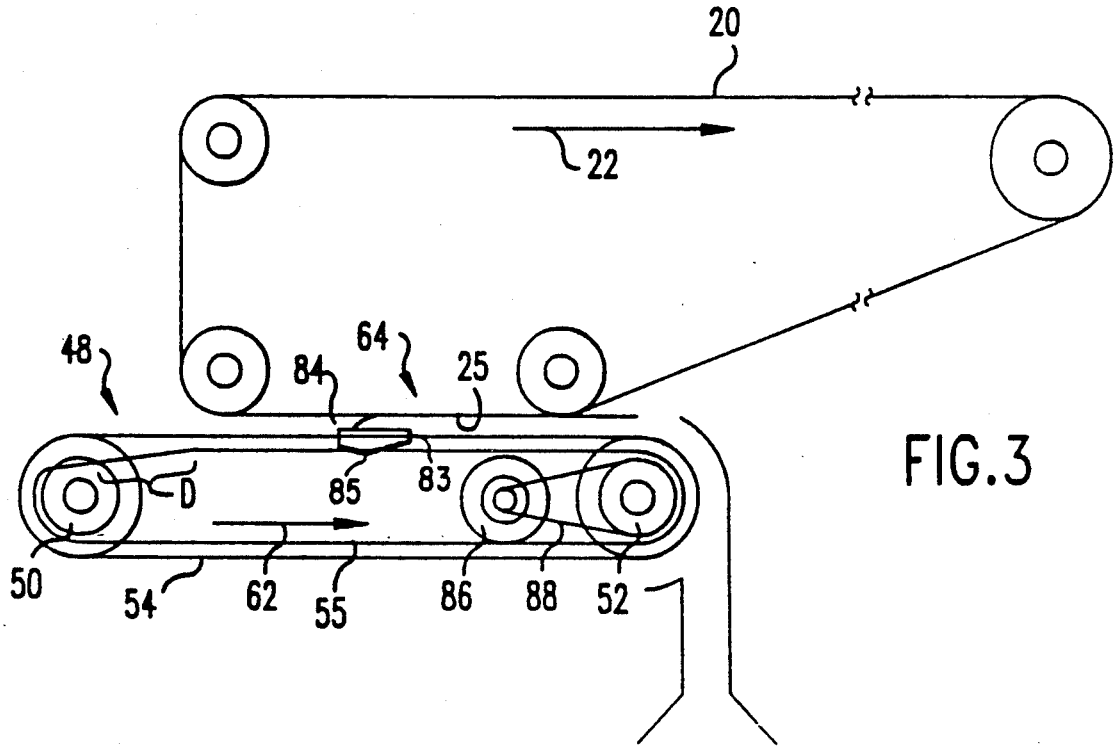
FIG. 3 is a schematic elevational view showing further details of the sheet transport system used in the electrophotographic printing machine of FIG. 1 and also showing the sheet gripper of the sheet transport system at a position within the transfer zone.
Figure 4:
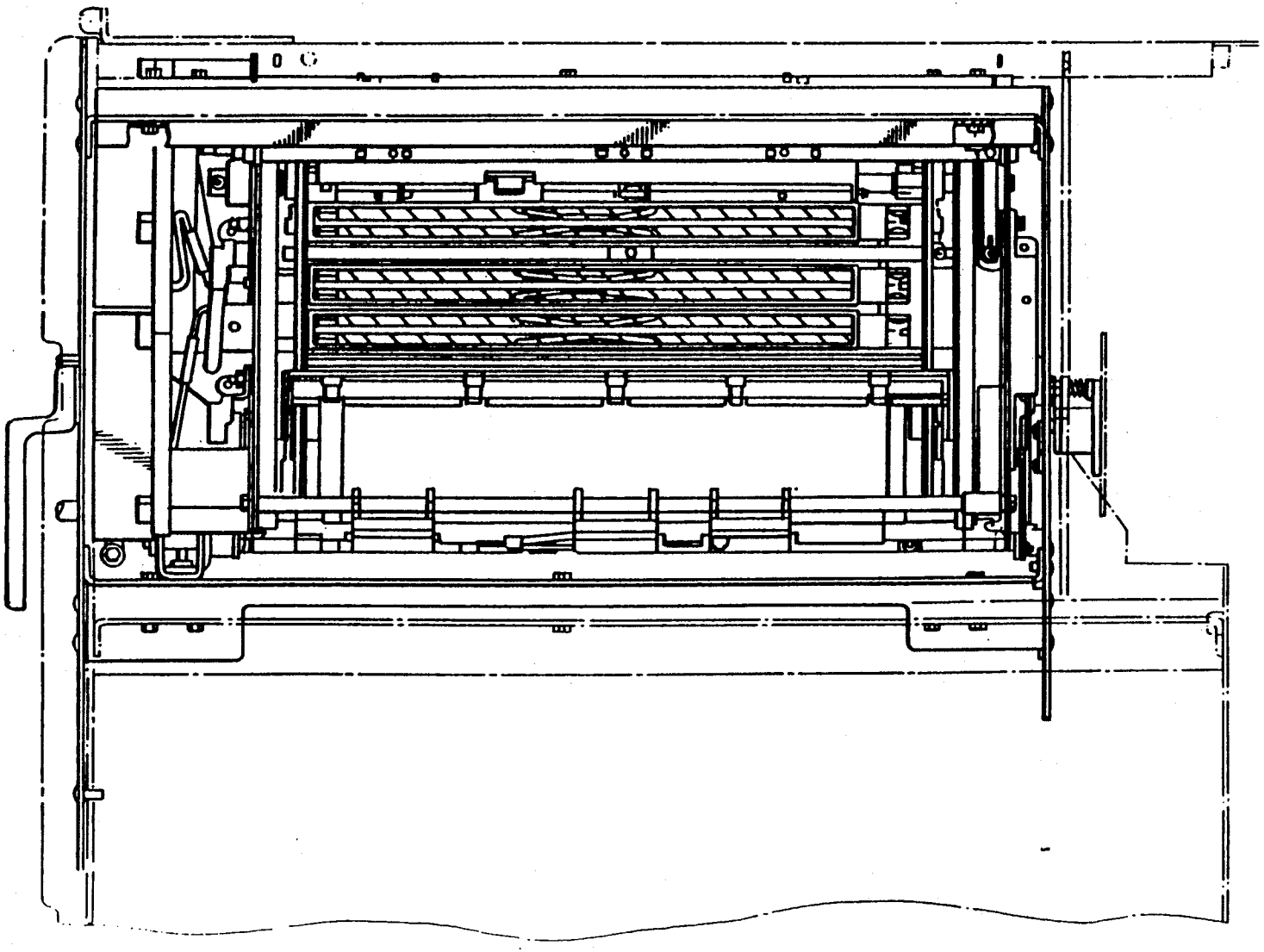
FIG. 4 is a an overhead plan view of the TRTL and TRD.
Figure 5:
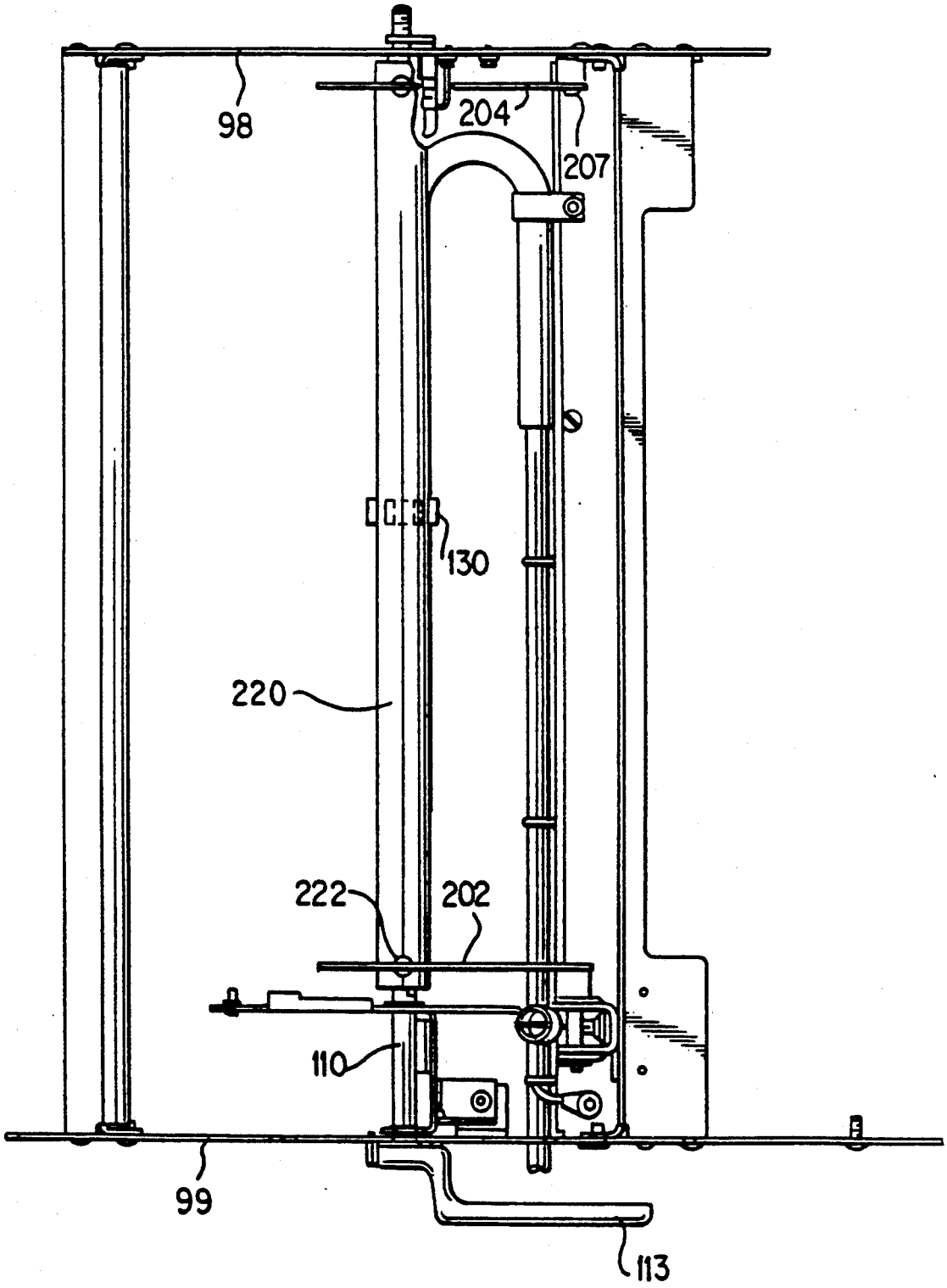
FIG. 5 is a top plan view of the TRD mounting structure, with the TRTL and registration module removed for greater clarity.
Figure 6:
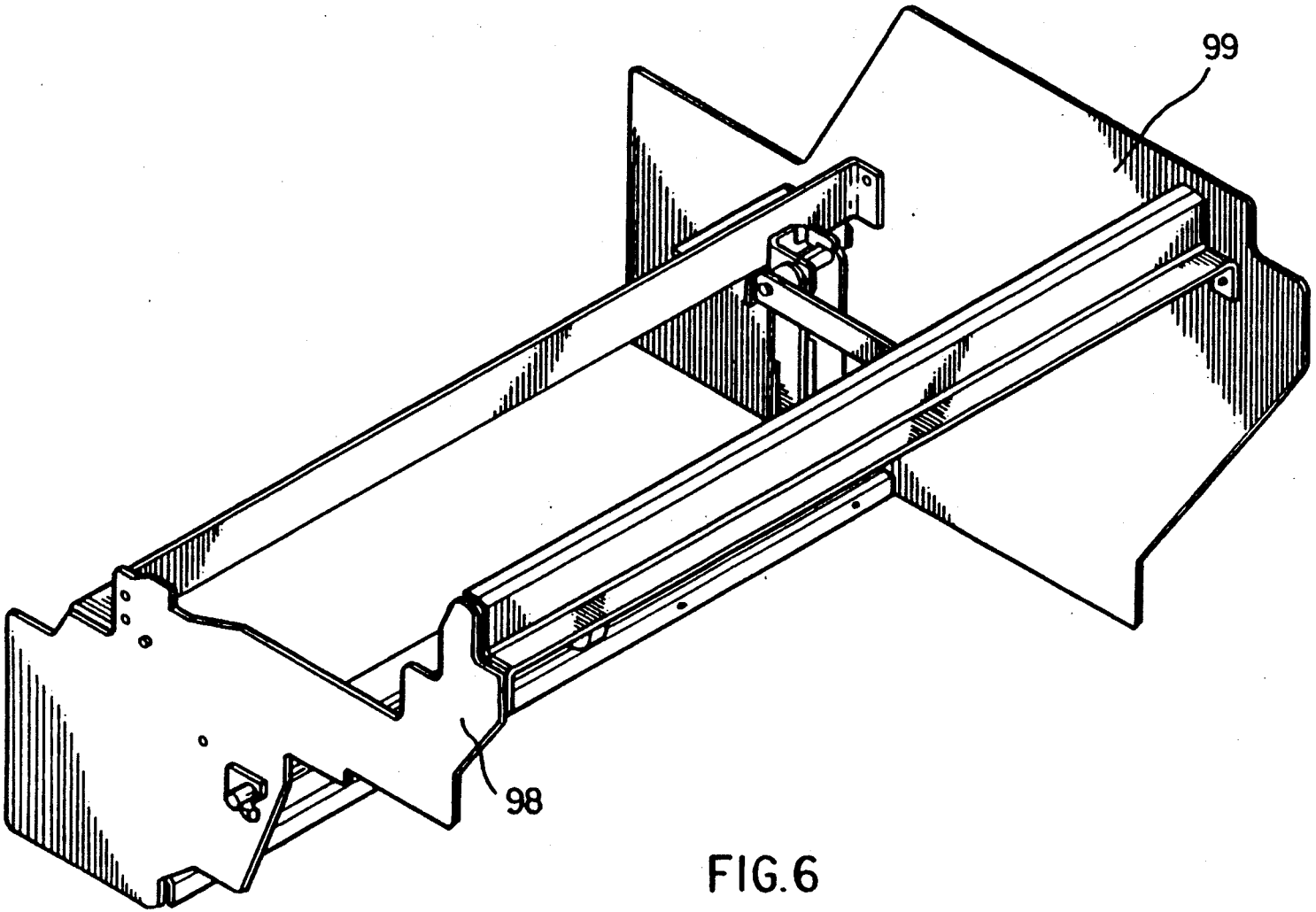
FIG. 6 is a perspective view of the TRD shown looking from the inboard to the outboard sides.
Figure 7:
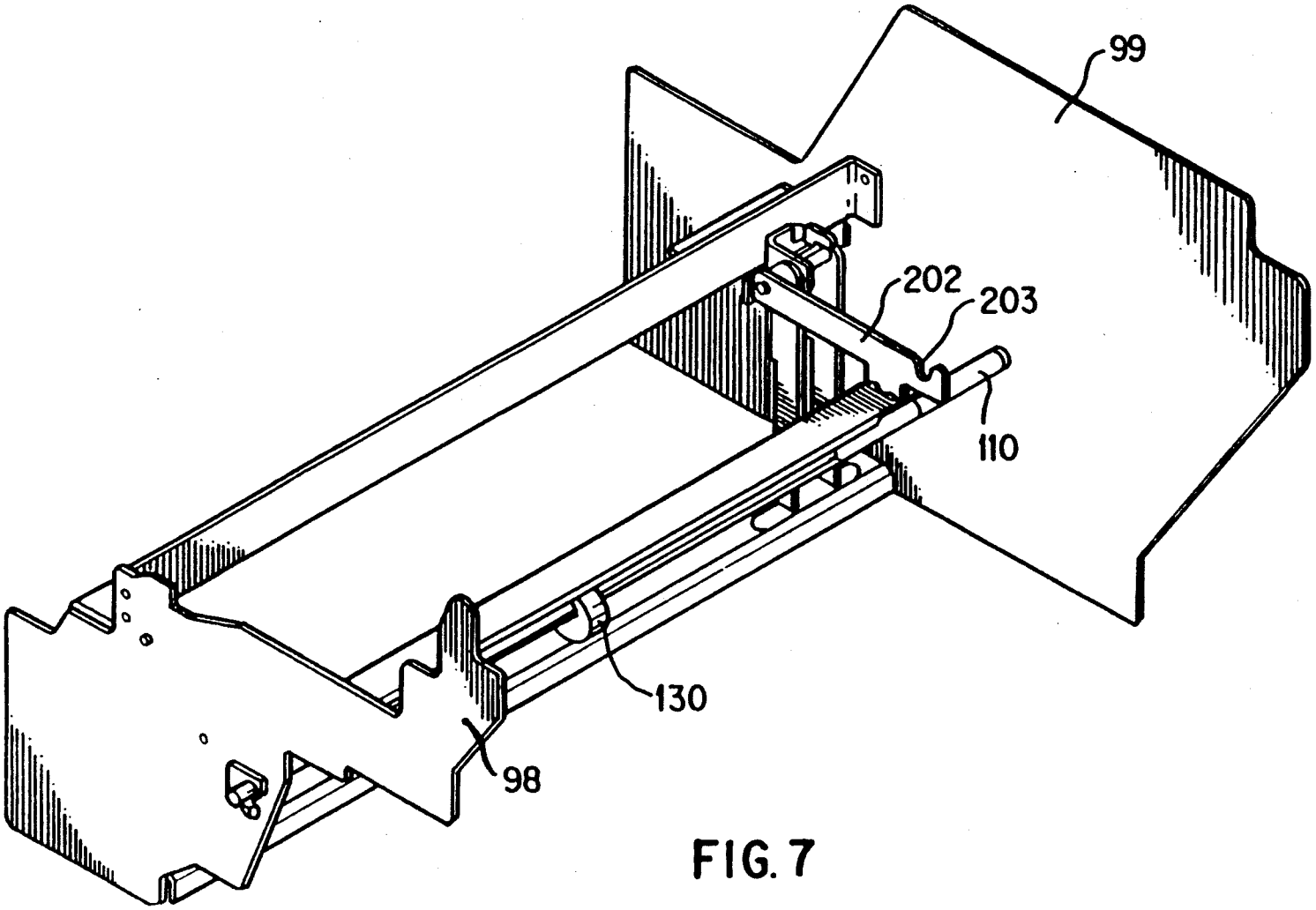
FIG. 7 is a perspective view of the TRD with the left tie bar removed for greater clarity.
Figure 8:
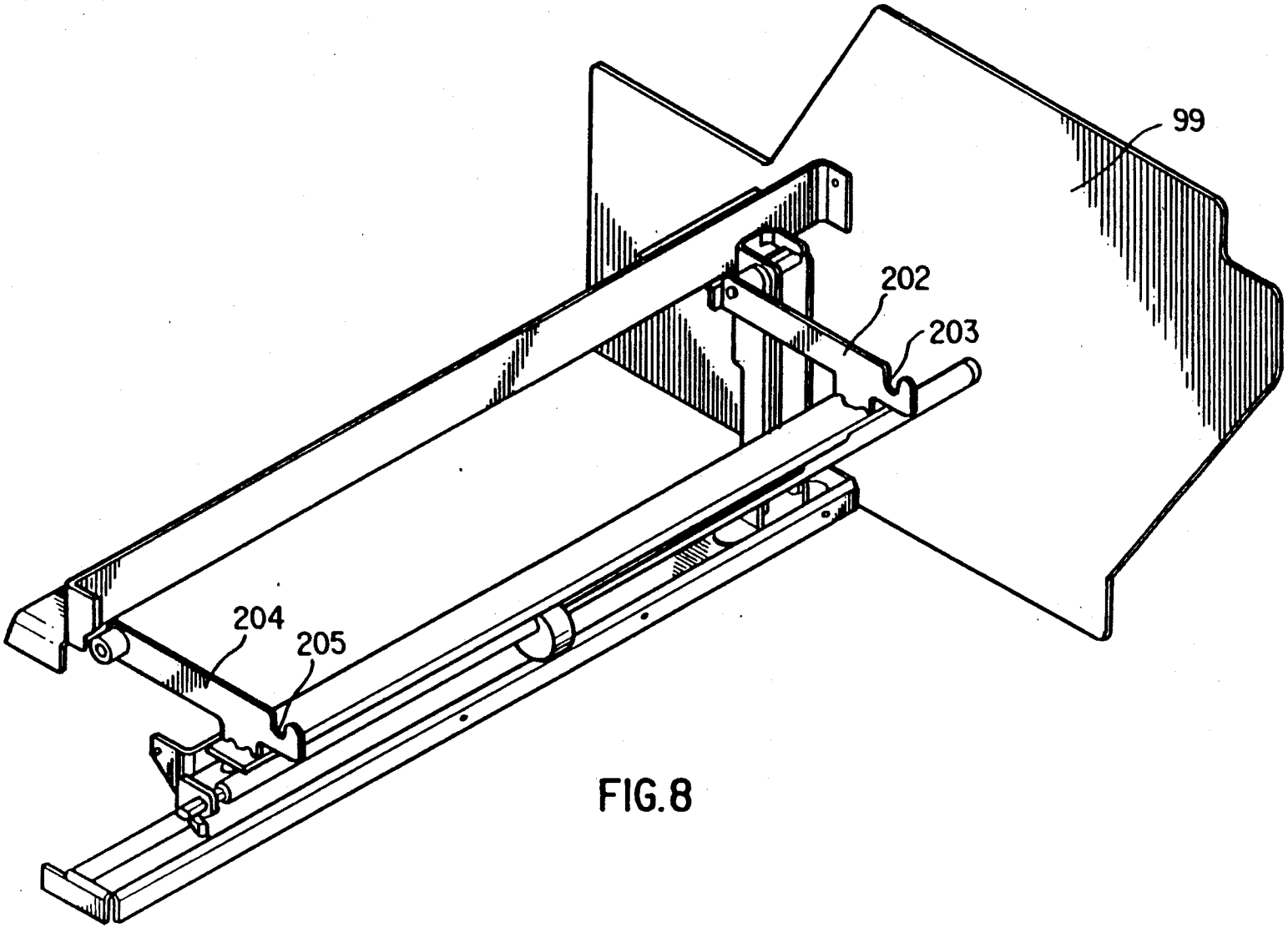
FIG. 8 is a perspective view of the TRD with the rear plate and left tie bar removed for greater clarity.
Figure 9:
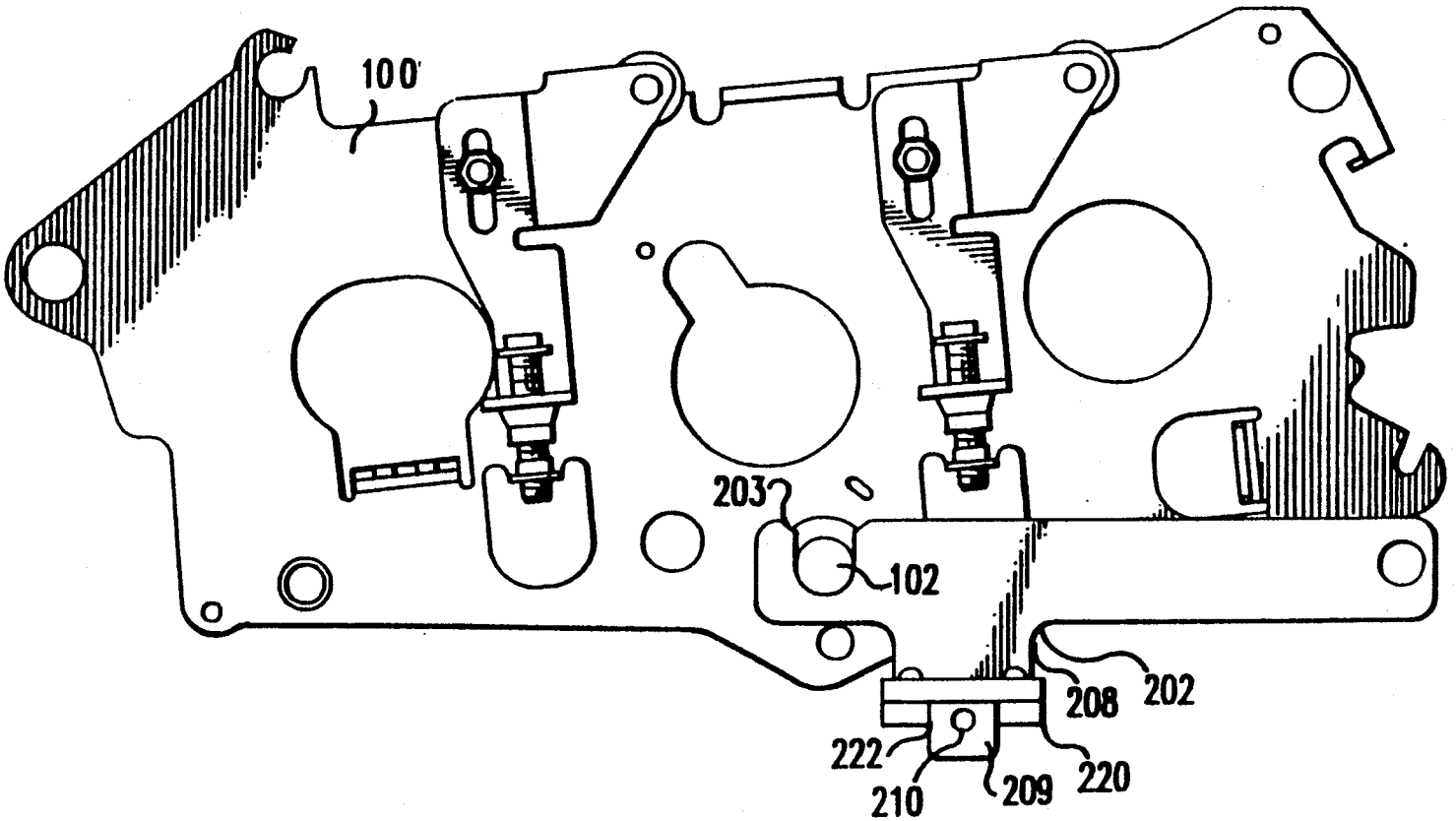
FIG. 9 is a partial sectional view of the TRTL outboard side and portions of the mount.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper or transparent plastic. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. This type of transport is known as a two roll transfer loop, or TRTL. A sheet gripper, generally indicated by the reference numeral 84 (see FIGS. 2-3), extends between belts 54 and moves in unison therewith. A sheet 25 is advanced from a stack of sheets 56 disposed on a tray. A friction retard feeder 58 advances the uppermost sheet from stack 56 onto a pre-transfer transport 60, also known as a registration module. Transport 60 advances sheet 25 to sheet transport 48, maintaining proper alignment throughout. Sheet 2 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport apparatus will be discussed hereinafter with reference to FIGS. 2-3. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

In the discussion that follows, the front side of the machine is said to lie along the "outboard" direction, and the back side of the machine is said to lie along the "inboard" direction.

Modularity is an important feature of electrorepographic machines. It allows sites of potential problems to be isolated by the user and better enable the user to resolve these problems. Accordingly, in the reprographic machine of the invention, the photoconductive belt and developer units are grouped together in a so-called xerographic modular drawer or XMD, which is generally accessible only by trained technicians. Nested within the xerographic module drawer and retractable therefrom on rails is the TRTL and registration gate assembly drawer 61, hereinafter referred to as the TRD. The TRD contains those components which place paper or other copy stock material into contact with the photoconductive belt for image transfer.

Copy stock is moved through a baffle system associated with the registration module 60 to the TRTL loop, where it is held and further moved by a gripper bar. The paper is feed to the two roll transfer loop or TRTL by the registration module 60 which helps transport paper from the storage bin to the TRTL module 48 in proper alignment. Occasionally, this structure will experience paper jams, necessitating cessation of operation of the machine until the paper jam is cleared. To facilitate the clearance of paper jams, the TRD is mounted within the XMD on rails.

FIGS. 5–8 provide overhead and perspective views of the underlying TRTL/registration module suspension and mounting system employed. The TRTL side walls 100 contain outwardly projecting pivot pins on the inboard (101) and outboard (102) sides which extend a length sufficient for their projection across a set of inboard and outboard cradle arms 204 and 202 of the mount, and through the side walls 401 of the registration gate assembly. These pins 101 and 102 are thus seen to mount into the slots 203, 205 located on the pair of spaced apart cradle arms 202 and 204 respectively. These cradle arms are generally asymmetrically disposed with respect to a downwardly extending tab portion 208 whose terminal portion 209 defines a transverse hole 210. The two cradle arms are loosely connected from the inboard to the outboard side by an elongated rectangular leaf spring 220 which serves as a lifting bar. The leaf spring has at either end a hole 222 through which the tab 209 of the respective cradle arm projects. A pin is threaded through the holes in the tab portion of the cradle arms so that the cradle arms are generally constrained only against movement away from the plane of the lifting bar 220, but can rotate with respect thereto.

Figure 23:
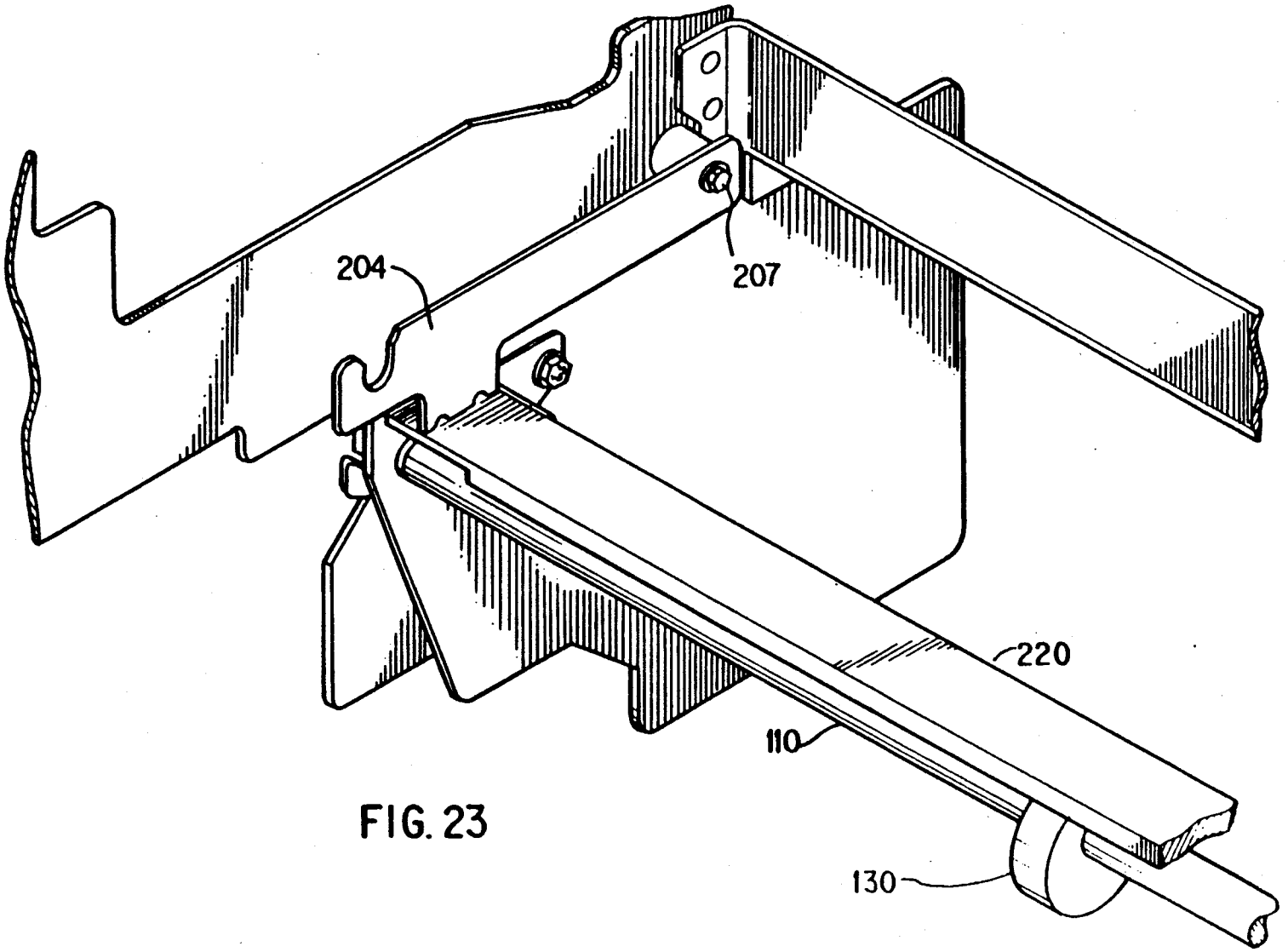

At its inboard side, the end of the cradle arm opposite the slot is pivoted to the inboard side wall 98 of the TRD. Situated beneath the leaf spring and traversing the TRD from side wall to side wall is a camshaft 110 which projects outwardly from both side walls, terminating at its inboard side in safety latch structure (which shall be further explained below), and at its outboard side in a lifting handle 113. Located at the central portion of the camshaft is cam structure 130. The camshaft is spaced beneath the leaf spring or lifting bar at such a distance so that when the handle connected to the camshaft is rotated 180°, the cam cooperates with the lifting bar 220 to raise it into an elevated position, thereby also raising the TRTL and registration structure attached to the slots 203 and 205 of the cradle arms 202 and 204. The lifting bar and cam shaft are elastic so that together they can provide a force vector in the upward direction. As the camshaft turns and the lifting bar is raised or lowered, the inboard cradle arm 204 pivots in the vertical plane at one end about a pivot 207 (FIG. 23).

Figure 11:
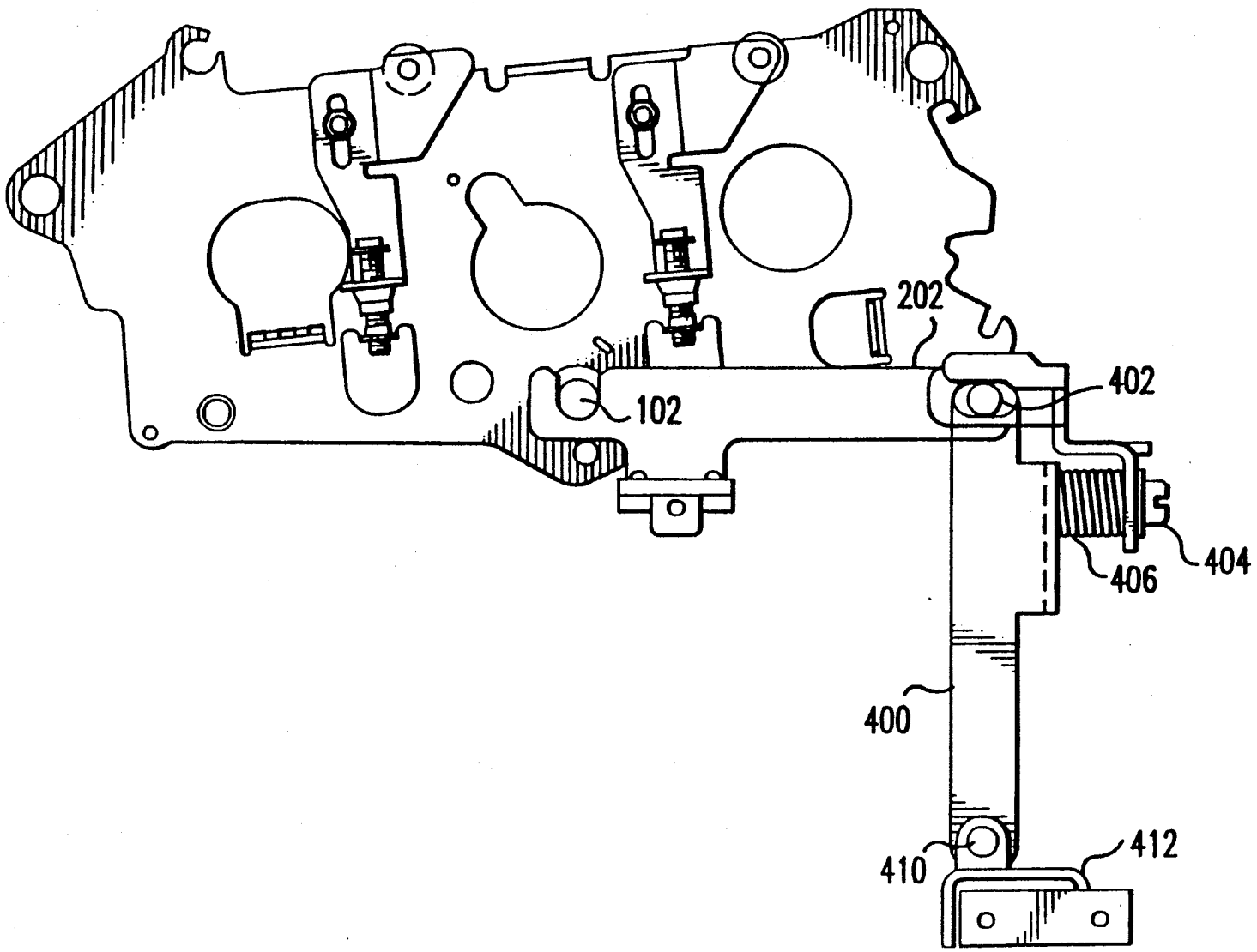
FIG. 11 is a partial end view of the outboard side of the mount, showing the skew mechanism.
Figure 12:
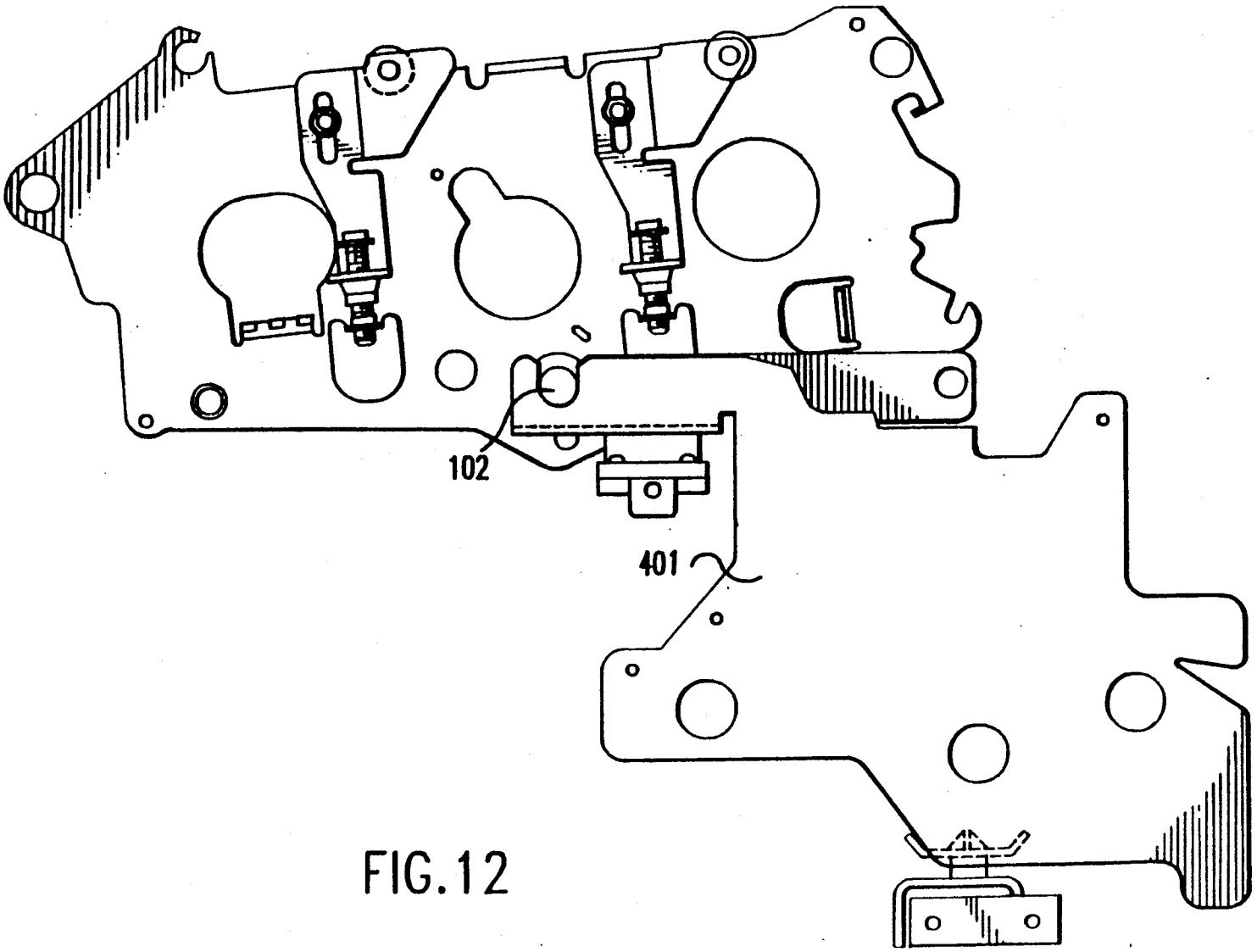
FIG. 12 is a view similar to that of the previous figure, showing the cooperation with the registration gate assembly.
Figure 20:
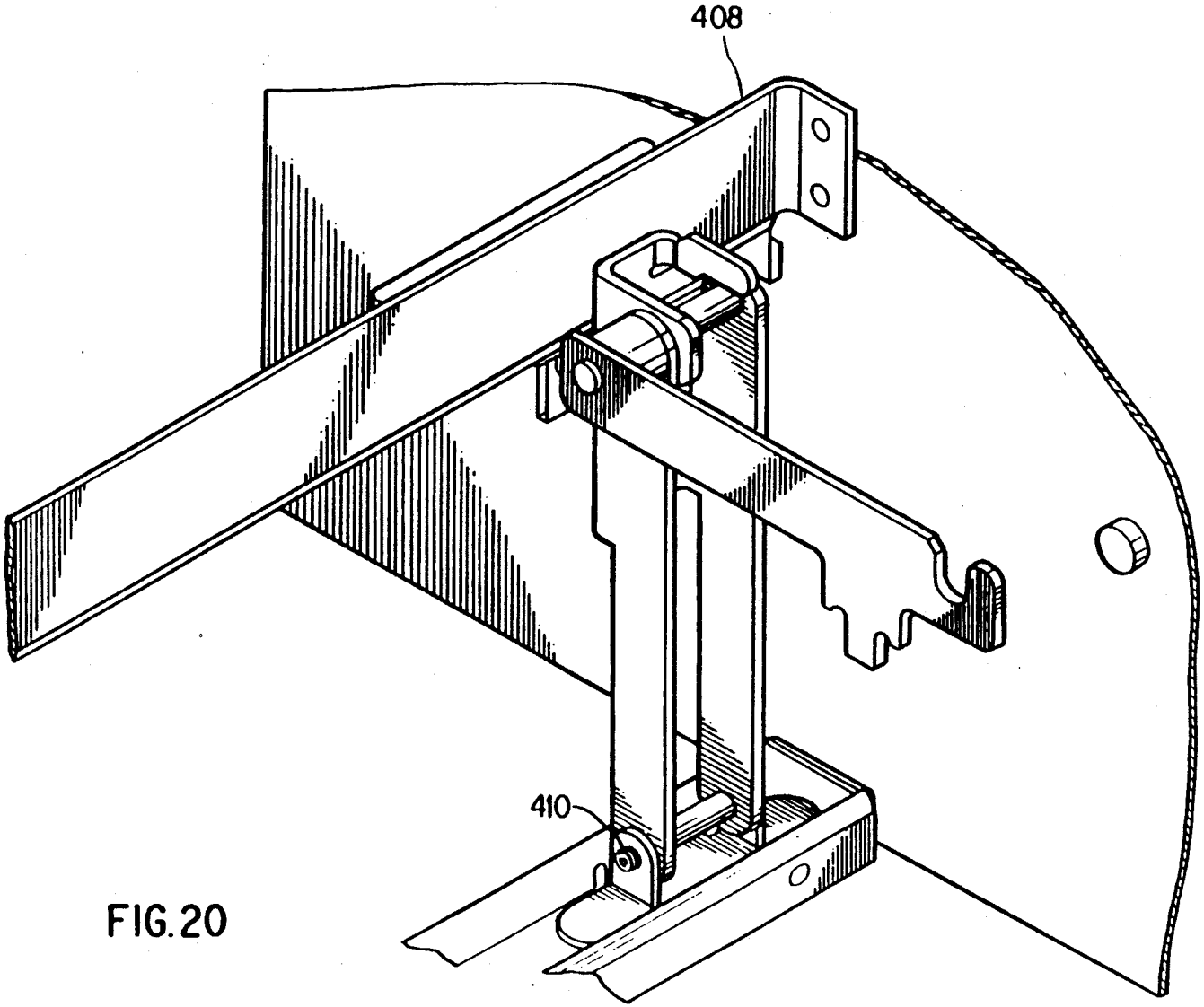
Figure 21:
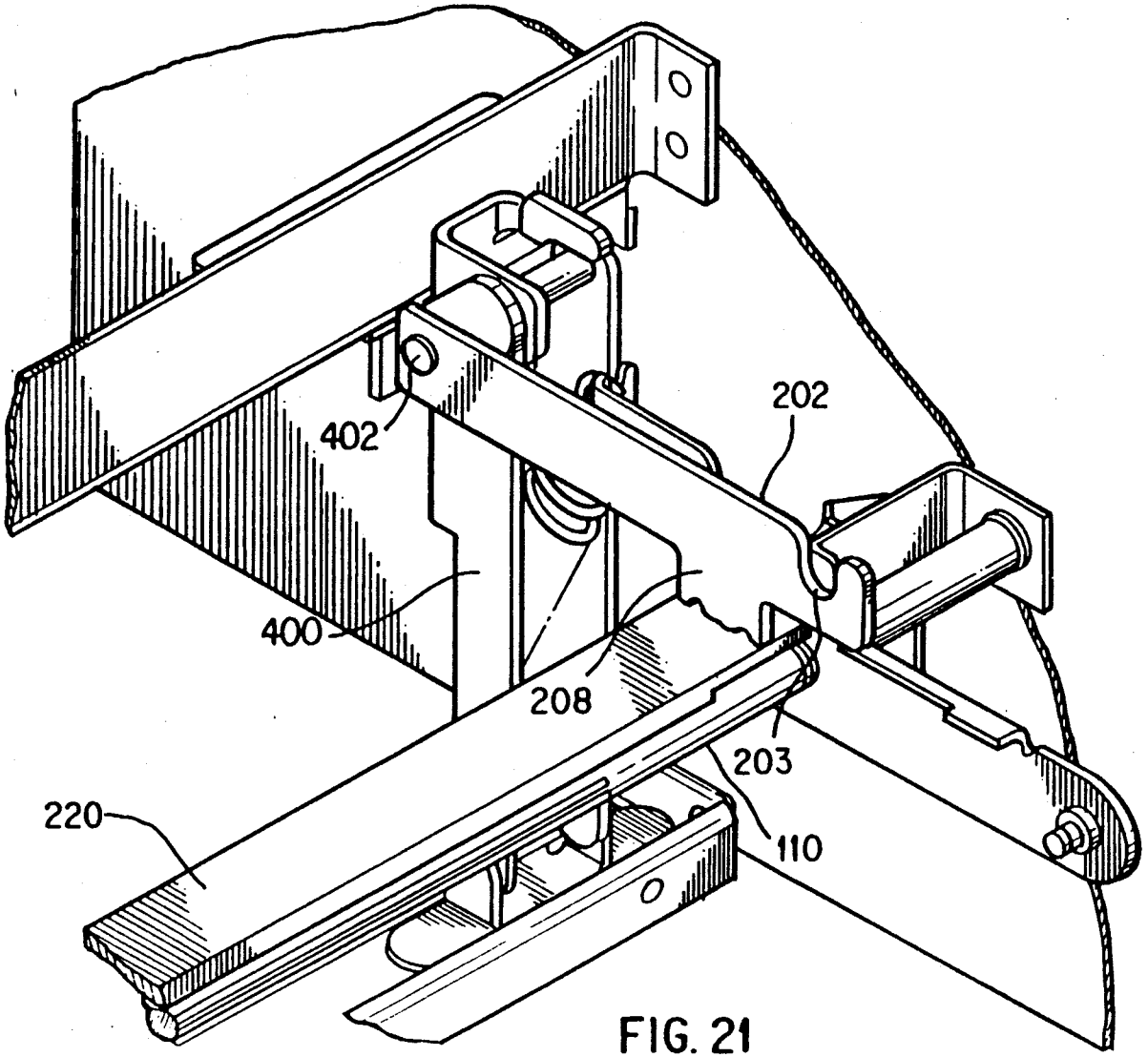

The TRD is spanned by several additional brackets from its inboard wall to its outboard wall. These brackets provide grounding structure for the attachment of other elements which shall be described below. The outboard cradle arm of the suspension is not rigidly pivoted to the outboard side wall 98. Rather, (see FIG. 11) it is pivotally connected to a generally vertical pivot arm 400 which in turn is connected via a pivot 410 to a lower tie bar or ground bracket 412 as shown in FIGS. 11 and 20. Associated with this vertical arm is a skew adjustment screw 404 and spring 406 threaded through a grounded bracket or tie bar 408 attached to or part of a transversely extending bracket. The spring helps prevent backlash in the mechanism. By making slight adjustments to the adjustment screw, one causes the vertical arm 400 to pivot slightly about an axis parallel to the inboard/outboard axis of the machine. This in turn causes the slight lateral movement of the outboard cradle arm with respect to the inboard cradle arm. This allows for the angular movement of the mounting about a vertical axis, and so provides a skew adjustment about this axis. The importance of this feature derives from the occasion need to adjust the orientation of the TRTL and registration drawer with respect to the photoconductive belt, the alignment of which is not adjustable.

Figure 13:
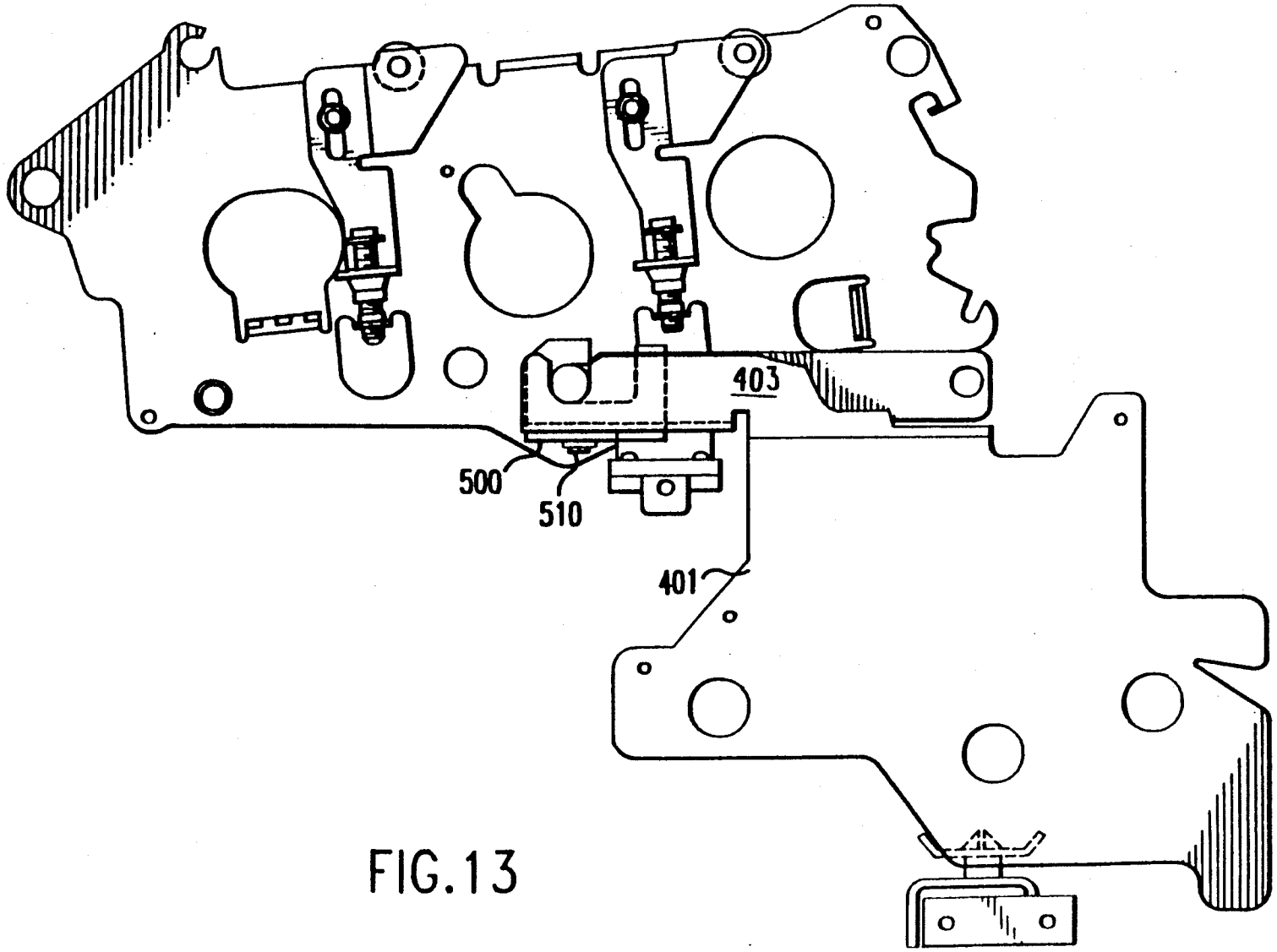
FIG. 13 illustrates the latch structure used with the structure of the previous figure.

As noted above, the TRTL is provided at either side with a common pin which projects outwardly from the TRTL and cooperates with the slot provided in each of the cradles. As seen in FIG. 13, the registration gate assembly also includes laterally extending portions 401 which provides slot structure into which this pin may also be placed. As seen in FIG. 13, there is further provided a latch 500 and locking screw 510 to lock together the pins extending from the TRTL with the registration gate assembly via the cradle arms. Therefore, any skew adjustments to the mount by movement of the cradle arms will result in the simultaneous movement of the TRTL and registration gate assembly. The lifting bar is only loosely connected to the cradle arms by means of hole and pin tab structure as set forth above, so that the cradle arms can undergo pivoting with respect to the lifting bar, thereby accommodating the skew movement.

Figure 14:
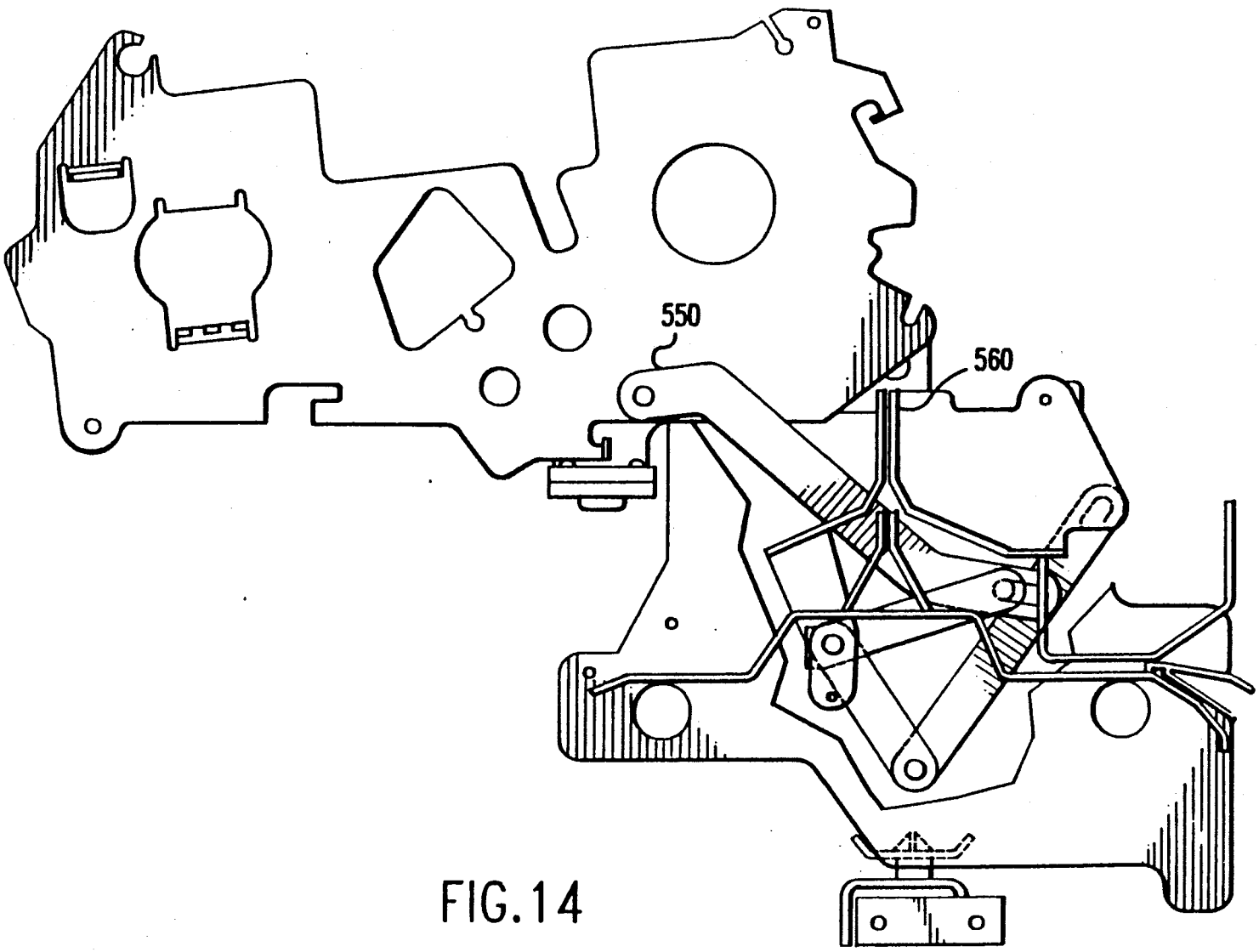
FIGS. 14 and 15 show the link structure used to open and close the baffles.
Figure 15:
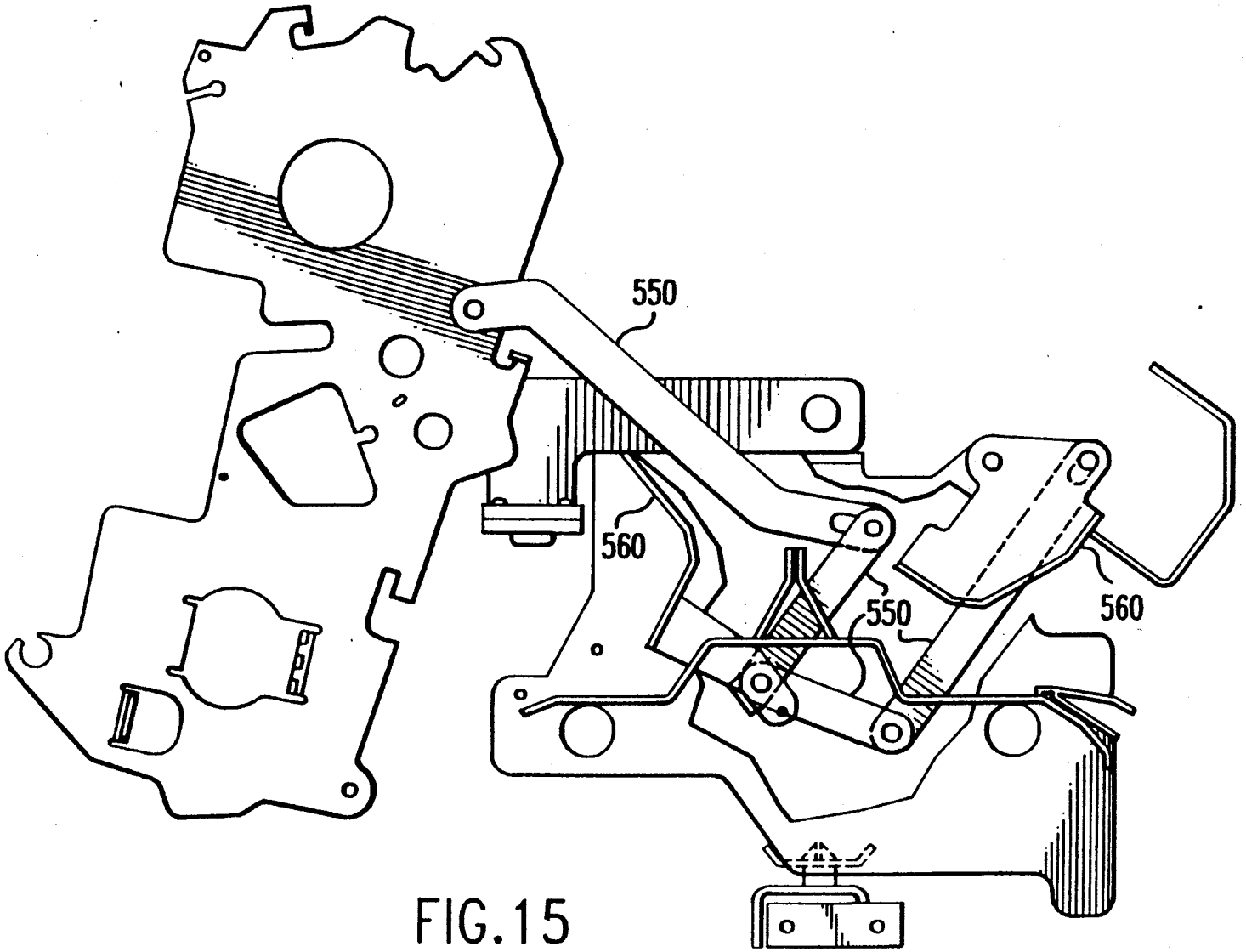

The side walls of the TRTL are linked to the registration baffles associated with the registration gate assembly by a multi-element linkage 550 as seen in FIGS. 14 and 15. When the drawer is in its extended, pulled out (TRTL down) position, the TRTL may be rotated about the common pivot pins 101 and 102. By means of the linkage 550, this movement also separates the baffles 560, thereby fully exposing the paper path and allowing one to clear it of any jams.

Figure 16:
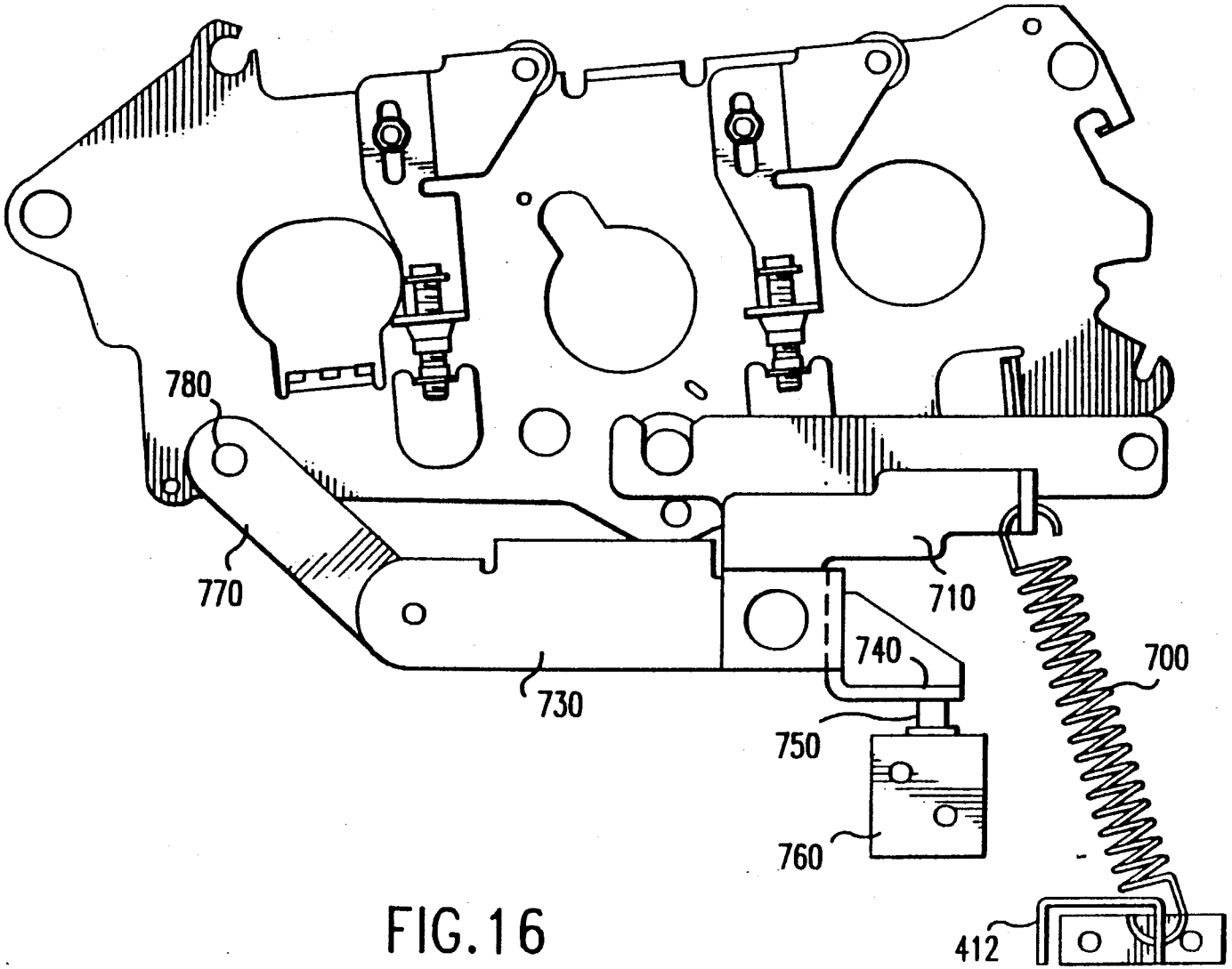
FIG. 16 is a partial end view similar to FIG. 1, but showing the counterbalance structure.
Figure 22:
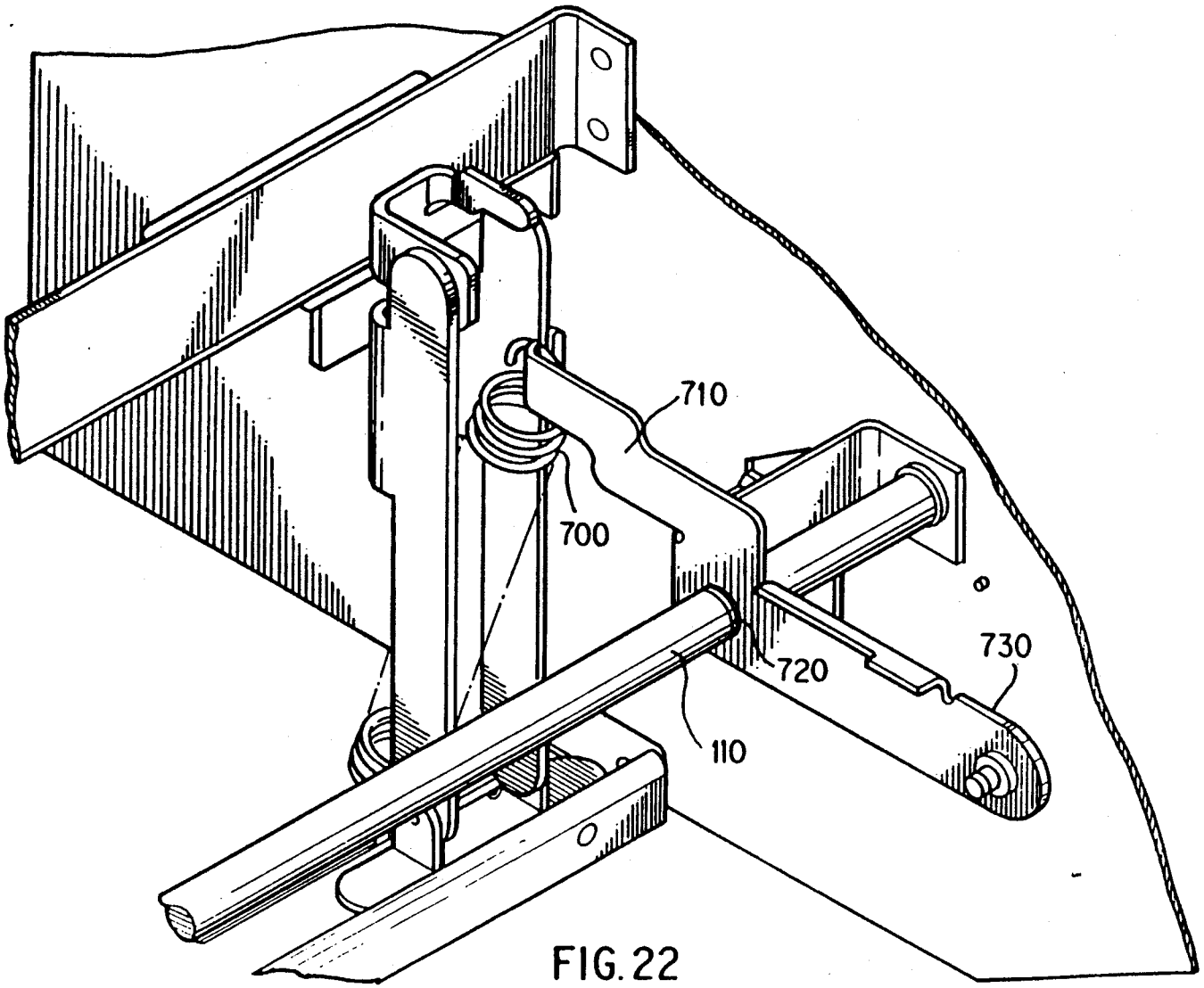

The mounting structure is further provided with a counterbalance feature so that as the TRTL is pulled out of the machine, it does not suddenly pivot and fall to one side. This feature also smoothens out the rate at which the TRTL is rotated. This structure is illustrated in FIGS. 16 and 22. A spring 700 is connected from the transverse ground rail or ground bracket to a counterbalance lever 730. The counterbalance lever extends from an S-shaped section 710 to another portion which is mounted at 720 about the camshaft for rotation thereabout. The counterbalance lever terminates in a link 770 which completes the connection of the spring to a point 780 located on the opposite portion of the outboard side wall of the TRTL mechanism (FIG. 16). A stop screw 750, grounded to one side of the TRD by a bracket 760, cooperates with a depending portion 740 of counterbalance lever 730 to provide a stop to prevent the mechanism from exerting force on the TRTL when it is in the "up" or running position.

Figure 10:
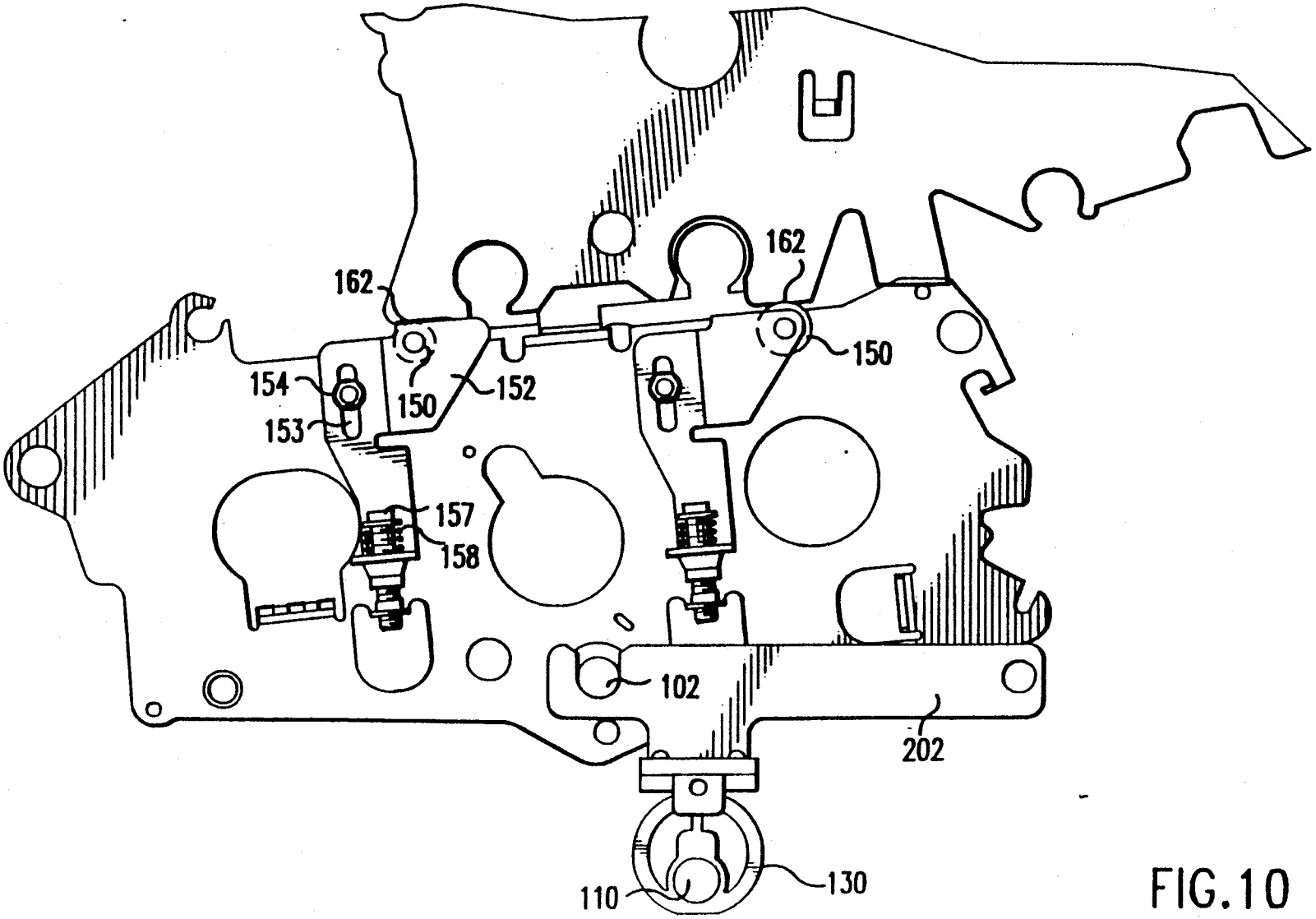
FIG. 10 is a view similar to that of the previous figure, further showing aspects of the invention.

As noted above, it is important that the upper surface of the TRTL be repeatedly positionable at a set distance beneath the underside of the photoconductive belt 20. This is accomplished by the provision of three TRTL rollers 150, two on the outboard side and one on the inboard side of the side plates of the TRTL as shown in FIG. 10. Alternatively, two rollers may be placed on the inboard side and one on the outboard side. Each roller is affixed to a bracket 152 which has a slot 153 and cooperates with a nut and bolt 154 for vertical adjustments of the rollers with respect to the TRTL, which are controlled by an adjustment screw 157 having a spring 158 to remove backlash. A pin and spring structure 157 is provided for finer adjustments to the position of the TRTL stage rollers. These rollers cooperate with flat staging portions 162 on the underside of the photoconductive module as shown in FIG. 10. This three-point balancing structure helps to reestablish a proper spacing of the TRTL with respect to the photoconductive belt whenever the TRD is inserted into the machine.

Figure 18:
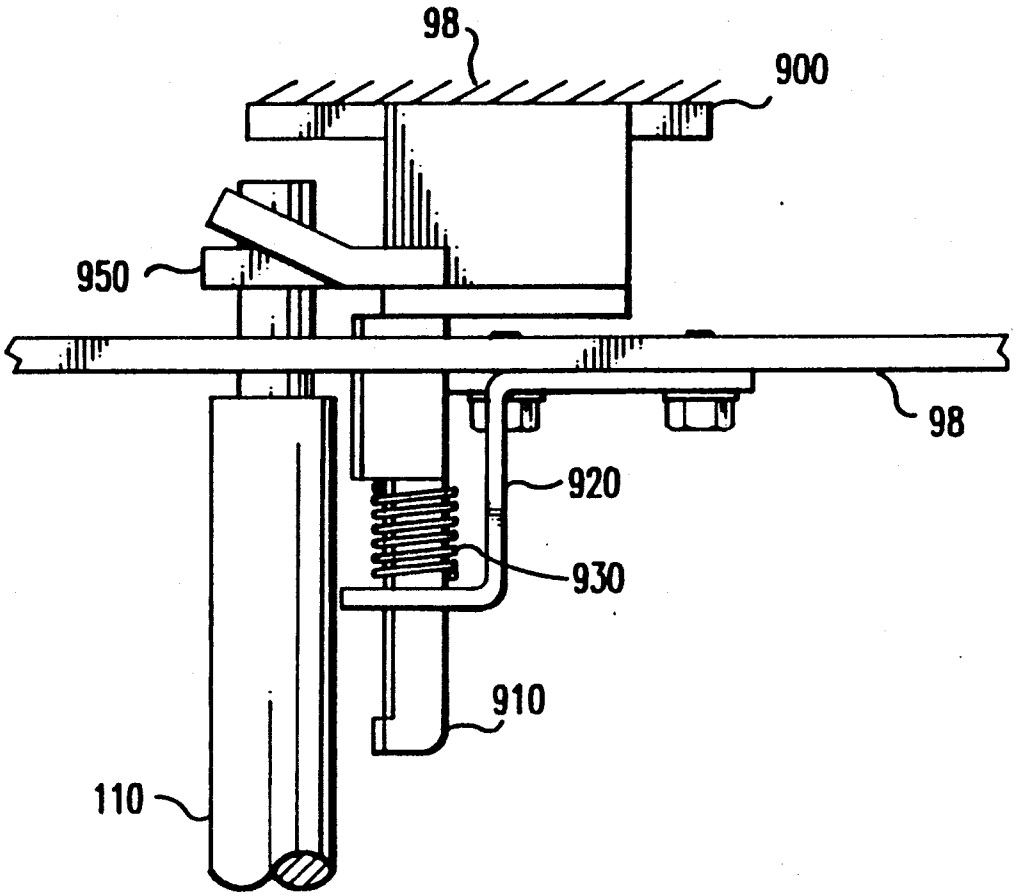
FIG. 18 provides a sectional view of the latch structure on the inboard side of the TRD.
Figure 19:
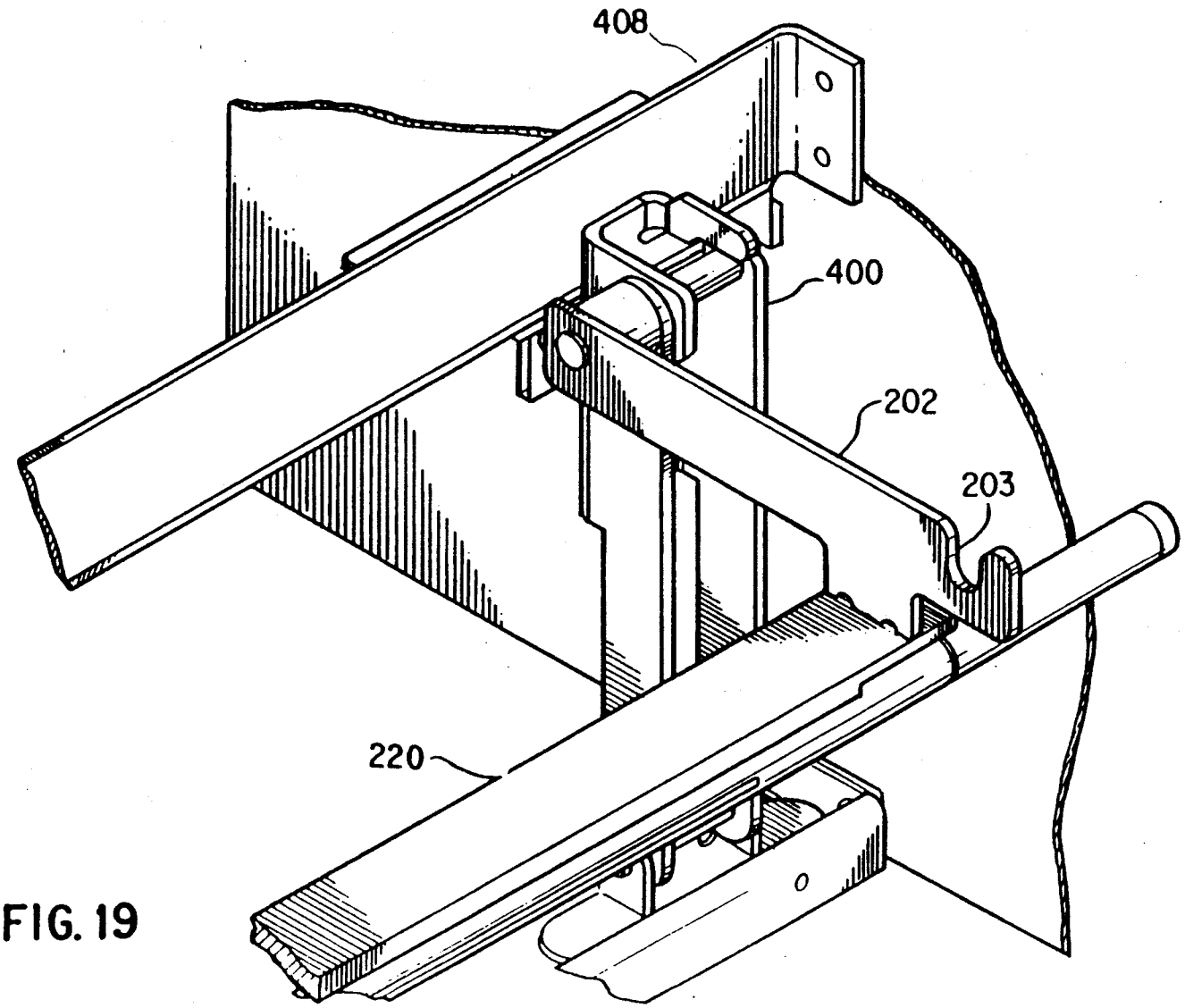
FIGS. 19–24 provide perspective views of certain selected aspects of the mount.
Figure 24:
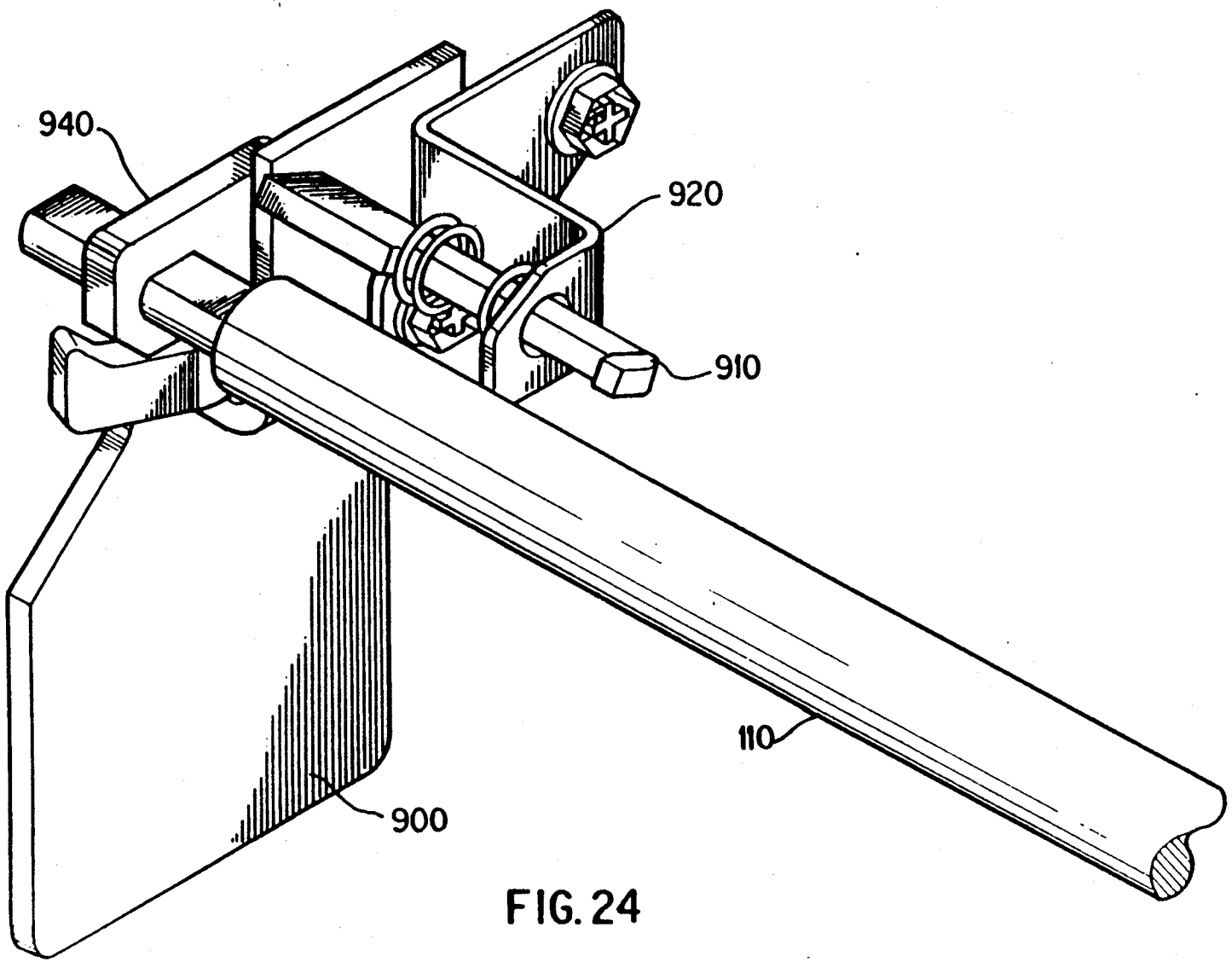
Figure 25:
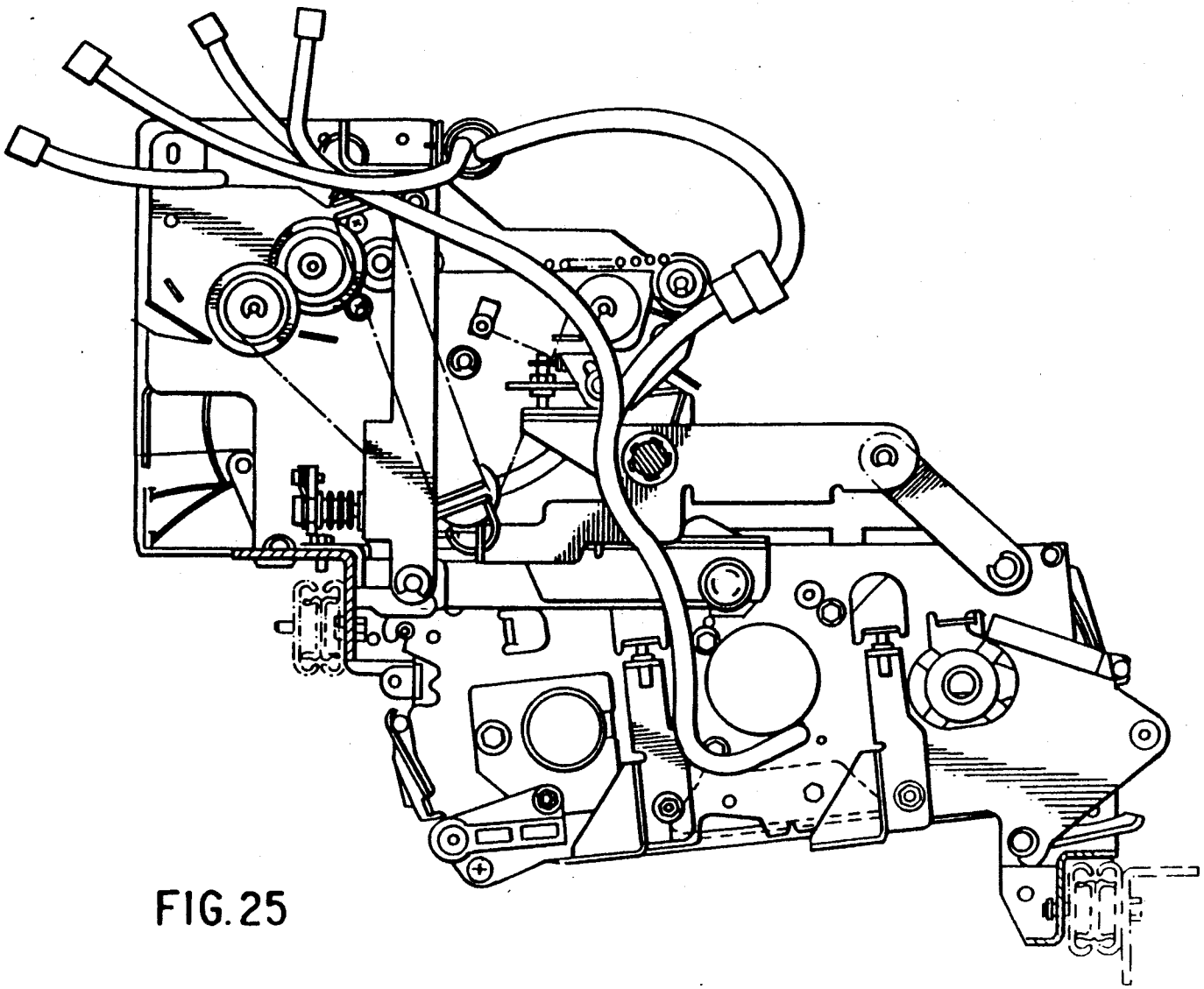
FIG. 25 is a front plan view of the mount, TRTL, and registration gate assembly, removed from the TRD.

FIGS. 18 and 24 illustrate a safety feature. The invention makes use of a latch structure 940 to prevent the movement of the TRTL before it has been lowered a safe distance below the photoconductive belt. The camshaft terminates at its inboard side with a projecting portion 950 which cooperates with a latch 940 and machine-mounted latch bracket 900. A stop 910 is also provided by bracket pin 920 and spring structure 930 affixed to the inboard TRD wall 98. This prevents the handle from being rotatable so as to prevent the premature raising or lowering of the TRTL at any time other than when the TRD is in its fully inserted position, at which position is must cooperate with the latch structure grounded to the rear casing of the machine for handle rotation to be enabled.

Figure 17:
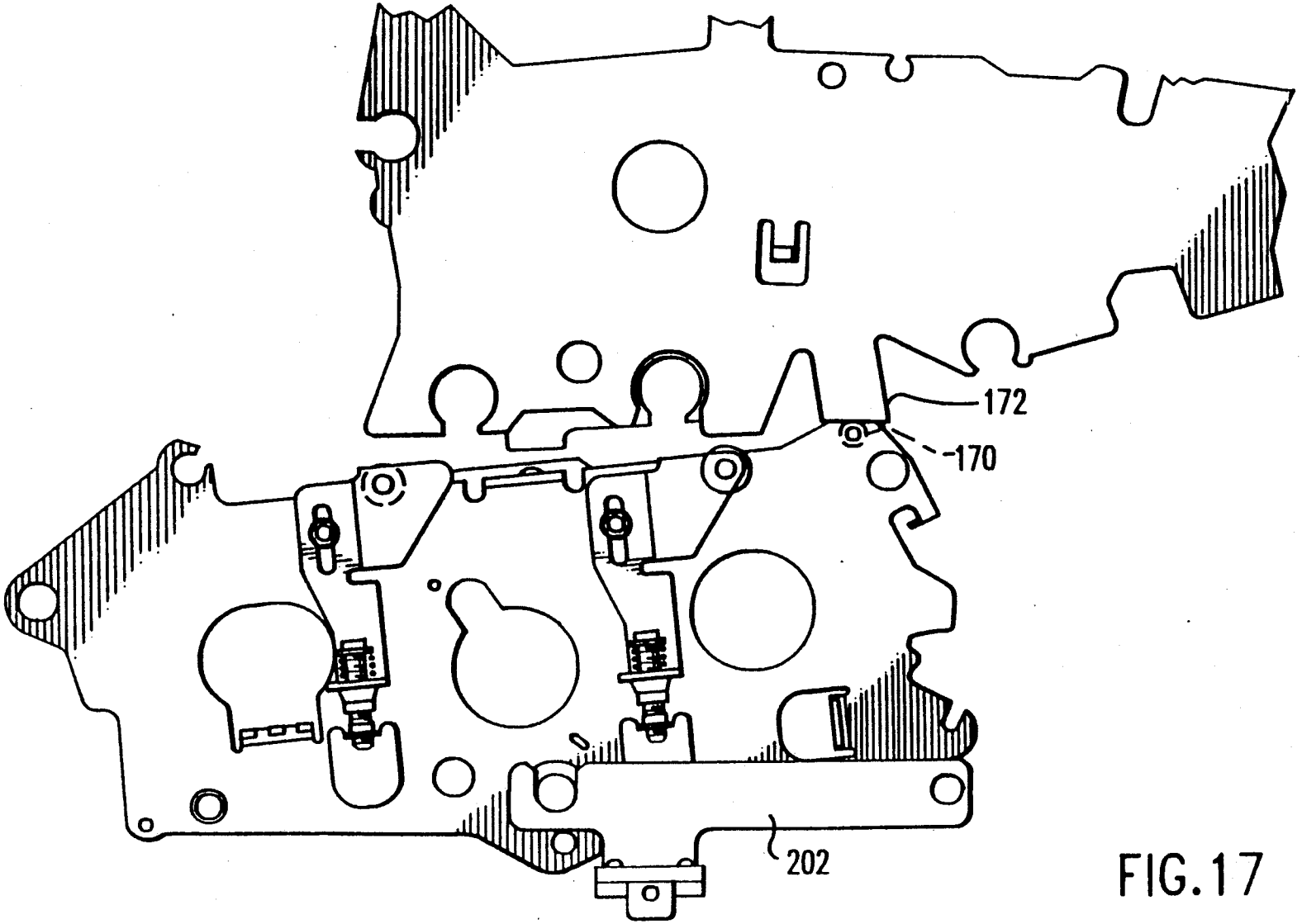
FIG. 17 shows the TRTL tie bar.

The side walls of the TRTL are provided with a TRTL tie bar 170 which cooperates with an antirotation feature 172 on the photoconductive module (FIG. 17). This prevents the rotation of the TRTL module while the module is being withdrawn from the outer module drawer, and so helps avoid any damage to the photoconductive belt.

In practice, the operator of the machine would be alerted to a paper jam in the region of the TRD by a warning light or other signal provided by the machine. The operator would then rotate the handle on the TRD 180°, during which the drawer is locked against outward movement. The rotation causes the TRD and linked registration module to be lowered away from the photoconductive surface. Once the handle is fully turned, the latch structure on the rear of the drawer is cleared, thereby enabling one to pull the drawer away from the machine. The exposed TRTL may then be rotated in the counterclockwise direction, which by means of linkages described above, also serves to open the baffles of the TRD and expose a sufficient portion of the paper path to allow any paper jam to be cleared.

What is claimed is:

1. An apparatus for providing a mounting for a transfer loop, comprising:

a lifting bar, said lifting bar having an inboard end and an outboard end and further having a hole at each end;

a pair of cradle arms, each cradle arm having a horizontal section with a first end and a second end, and an intermediate section from which depends a tab portion having a transverse hole, said tab being sized to be inserted into the holes at the ends of the lifting bar; and slot structure located near one of the ends of each of the cradle arms.

2. The apparatus of claim 1, further comprising:

a housing sized to contain the lifting bar and cradle arms, said housing having an inboard wall and an outboard wall;

a cam shaft traversing the housing, said cam shaft being spaced in parallel underlying relationship with respect to the lifting bar, said cam shaft terminating at one end with handle means;

a bracket traversing the housing from its inboard wall to its outboard wall; and pivot means connecting the inboard wall with the end of the inboard cradle arm furthest from the slot in that arm.

3. The apparatus of claim 1, further comprising:

a housing sized to contain the lifting bar and cradle arms, said housing having an inboard wall and an outboard wall;

a cam shaft traversing the housing, said cam shaft being spaced in parallel underlying relationship with respect to the lifting bar, said cam shaft terminating at one end with handle means;

a bracket traversing the housing from its inboard wall to its outboard wall; and a counterbalance lever mounted for free rotation about the cam shaft, and spring means for providing a downwardly extending force to one end of the counterbalance lever.

4. The apparatus of claim 3, further comprising a transfer loop having a housing from which extends pivot means, said pivot means cooperating with the slot structure of the cradle arms so as to allow for the pivoting of the transfer loop with respect to the cradle arms.

5. The apparatus of claim 4, wherein the counterbalance provides a counter-force to the weight of a portion of the transfer loop.

6. The apparatus of claim 4, further comprising a registration module linked to the pins of the transfer loop.

7. The apparatus of claim 6, including registration baffles and means for opening the registration baffles when the transfer loop is pivoted with respect to the registration module.

8. The apparatus of claim 1, further comprising:

a housing sized to contain the lifting bar and cradle arms, said housing having an inboard wall and an outboard wall;

a cam shaft traversing the housing, said cam shaft being spaced in parallel underlying relationship with respect to the lifting bar, said cam shaft terminating at one end with handle means;

a bracket traversing the housing from its inboard wall to its outboard wall; and a means for skewing one cradle arm with respect to the other cradle arm.

9. The apparatus of claim 8, wherein the skewing means comprises a vertical bar pivotally attached to a bracket grounded to the housing, said vertical bar being pivotally linked at its upper end to one end of the outboard cradle arm, and further including means for selectively altering the angular displacement between the vertical arm and the outboard cradle arm.

10. The apparatus of claim 1, further comprising:

a housing sized to contain the lifting bar and cradle arms, said housing having an inboard wall and an outboard wall;

a cam shaft traversing the housing, said cam shaft being spaced in parallel underlying relationship with respect to the lifting bar, said cam shaft terminating at one end with handle means; and a bracket traversing the housing from its inboard wall to its outboard wall.

11. A transfer loop mounting structure, comprising:

a transfer loop housing having inboard and outboard walls from each of which projects a pin;

a lifting bar, said lifting bar having an inboard end and an outboard end and further having a hole at each end;

a pair of cradle arms, each cradle arm having a horizontal section with a first end and a second end, and an intermediate section from which depends a tab portion which has a transverse hole, said tab being sized to be inserted into the holes at the ends of the lifting bar;

slot structure located near one of the ends of each of the cradle arms;

a housing sized to contain the lifting bar and cradle arms, said housing having an inboard wall and an outboard wall;

a cam shaft traversing the housing, said cam shaft being spaced in parallel underlying relationship with respect to the lifting bar, said cam shaft terminating at one end with handle means;

a bracket traversing the housing from its inboard wall to its outboard wall;

pivot means connecting the inboard wall with the end of the inboard cradle arm furthest from the slot in that arm;

means for providing an adjustable measurement datum for vertical measurement with respect to side walls of the transfer loop housing.

12. The apparatus of claim 11 wherein the datum means include a plurality of vertically adjustable rollers mounted onto the sides of the transfer loop housing.

13. The apparatus of claim 11, further comprising an anti-rotation bar traversing the upper portions of the side walls of the transfer loop housing.

14. The apparatus of claim 11, further comprising a pair of registration side walls having slots, said registration side walls being pivotally attached to the transfer loop housing by cooperation of the cradle arm slots and the pins projecting from the transfer loop with the slots on the registration side walls.

15. The apparatus of claim 11, wherein the vertical position of the transfer loop is adjustable by rotation of the cam shaft.

* * * * *

UNITED STATES PATENT AND TRADEMARK OFFICE

CERTIFICATE OF CORRECTION

PATENT NO. :5,169,141
DATED :December 8, 1992
INVENTOR(S) :David K. Ahl, et. al.

It is certified that error appears in the above-indentified patent and that said Letters Patent is hereby corrected as shown below:

On the Title page, item [75], inventor: Roman C. Kanola "should be changed to read -- Roman C. Kamola--.

| Column | Line | |
|---|---|---|
| 1 | 48 | After "internal" insert --to--. |
| 2 | 16 | Change "affect" to --effect--. |
| 4 | 58 | Delete "a". |
| 7 | 63 | Change "Sheet 2" to --Sheet 25--. |
| 8 | 18 | Change "under" to -- under- --. |
| 8 | 20 | Change "documents" to --documents'--. |
| 8 | 54 | Change "enable" to --enables--. |
| 9 | 1 | Change "feed" to --fed--. |
| 10 | 7 | Change "occasion" to --occasional--. |
| 10 | 14 | Change "401" to --403--. |

Signed and Sealed this

Thirtieth Day of November, 1993

Bruce Lehman

*Attest:*

BRUCE LEHMAN

*Attesting Officer*

*Commissioner of Patents and Trademarks*